US012604965B2

(12) United States Patent
Kawagoe

(10) Patent No.: US 12,604,965 B2
(45) Date of Patent: Apr. 21, 2026

(54) FEEDING CONTAINER

(71) Applicant: TOKIWA CORPORATION, Nakatsugawa (JP)

(72) Inventor: Yukina Kawagoe, Kawaguchi (JP)

(73) Assignee: TOKIWA CORPORATION, Nakatsugawa (JP)

( * ) Notice: Subject to any disclaimer, the term of this patent is extended or adjusted under 35 U.S.C. 154(b) by 0 days.

(21) Appl. No.: 18/972,415

(22) Filed: Dec. 6, 2024

(65) Prior Publication Data

US 2025/0185784 A1 Jun. 12, 2025

(30) Foreign Application Priority Data

Dec. 7, 2023 (JP) ..... 2023-207123
Dec. 7, 2023 (JP) ..... 2023-207125

(51) Int. Cl.
*A45D 40/06* (2006.01)
*A45D 40/22* (2006.01)

(52) U.S. Cl.
CPC ..... *A45D 40/065* (2013.01); *A45D 40/221* (2013.01)

(58) Field of Classification Search
CPC ..... A45D 40/023; A45D 40/065; B43K 8/028
USPC ..... 401/59–60
See application file for complete search history.

(56) References Cited

U.S. PATENT DOCUMENTS 1,801,464 A * 4/1931 Ament ..... A45D 40/023 401/59
2,089,832 A * 8/1937 Kasdan ..... A45D 40/065 401/71
4,575,271 A * 3/1986 Hashimoto ..... B43K 8/003 401/107
4,973,178 A * 11/1990 Kakuta ..... A45D 40/065 401/59
7,637,371 B2 * 12/2009 Kang ..... A45D 40/065 401/59

FOREIGN PATENT DOCUMENTS

JP 7302810 B2 7/2023

* cited by examiner

*Primary Examiner* — David P Angwin
*Assistant Examiner* — Bradley S Oliver
(74) *Attorney, Agent, or Firm* — PROCOPIO, CORY, HARGREAVES & SAVITCH LLP

(57) ABSTRACT

A feeding container includes a container that includes a tubular accommodating portion configured to accommodate a cosmetic and has a first opening from which the cosmetic is exposed, a lid portion configured to open and close the first opening, and a lock member configured to lock the lid portion in a state where the lid portion closes the first opening. The lid portion opens and closes the first opening in a state where the lid portion is connected to at least one of the lock member and the container. When the lock member moves in an axial direction, which is a direction in which an axis of the accommodating portion extends, with respect to the container, locking of the lid portion due to the lock member is released, and the cosmetic is allowed to be exposed from the first opening.

6 Claims, 20 Drawing Sheets

FEEDING CONTAINER

CROSS-REFERENCE TO RELATED APPLICATIONS

This application is based on and claims priority under 35 USC 119 from Japanese Patent Application No. 2023-207123 filed on Dec. 7, 2023 and Japanese Patent Application No. 2023-207125 filed on Dec. 7, 2023, the contents of which are incorporated herein by reference.

TECHNICAL FIELD

The present disclosure relates to a feeding container.

BACKGROUND ART

Patent Literature 1 describes a cosmetic article storage container. The cosmetic article storage container includes a plate member that holds a cosmetic tool, an inner tube member in which the plate member is accommodated, a body member that accommodates the inner tube member and has an opening at an upper portion, a lid body that closes the opening of the body member, and an operating pin. The plate member is provided with an engagement hole, and the inner tube member is provided with a guide groove. The operating pin is engaged with the engagement hole in a state of penetrating the guide groove.

In the cosmetic article storage container, when the operating pin is pushed up, the plate member and the inner tube member are pushed up integrally with respect to the body member. When the inner tube member moves upward, the lid body is pushed up by an upper end portion of the inner tube member. Thereafter, when the inner tube member stops rising, the plate member is pushed up with respect to the inner tube member and the body member.

CITATION LIST

Patent Literature

Patent Literature 1: JP7302810B

SUMMARY OF INVENTION

According to one advantageous aspect of the present disclosure, there is provided a feeding container including:

- a container that includes a tubular accommodating portion configured to accommodate a cosmetic and has a first opening from which the cosmetic is exposed;
- a lid portion configured to open and close the first opening; and
- a lock member configured to lock the lid portion in a state where the lid portion closes the first opening, wherein
- the lid portion opens and closes the first opening in a state where the lid portion is connected to at least one of the lock member and the container, and
- when the lock member moves in an axial direction, which is a direction in which an axis of the accommodating portion extends, with respect to the container, locking of the lid portion due to the lock member is released, and the cosmetic is allowed to be exposed from the first opening.

(2) The feeding container according to the above (1) may be configured such that the lock member has a tubular shape into which the container is inserted, the container includes an operation portion that is operated to relatively rotate with respect to the lock member in order to feed out the cosmetic, the operation portion is relatively non-rotatable with respect to the lock member in a state where the lock member locks the lid portion, and the operation portion is relatively rotatable with respect to the lock member when the locking of the lid portion due to the lock member is released.

(3) The feeding container according to the above (1) or (2) may be configured such that the lid portion is pivotable via a hinge portion of the container, and opens and closes the first opening by pivoting via the hinge portion, and the lock member includes a second opening in which the cosmetic fed out from the first opening appears and a lock portion that is in contact with the lid portion to lock the lid portion.

(4) According to another advantageous aspect of the present disclosure, there is provided a feeding container including:

- a container that includes a tubular accommodating portion configured to accommodate a cosmetic and has a first opening from which the cosmetic is exposed;
- a support member configured to support the cosmetic inside the accommodating portion and to be movable in an axial direction which is a direction in which an axis of the accommodating portion extends;
- a lid portion being pivotable via a hinge portion and to open and close the first opening by pivoting via the hinge portion; and
- a push-up member configured to move in the axial direction with respect to the support member, and push up the lid portion to open the first opening.

(5) The feeding container according to the above (4) may be configured such that the accommodating portion has one or more guide holes penetrating the accommodating portion and extending in the axial direction, and the push-up member has a tubular shape into which the cosmetic is inserted and is movable in the axial direction inside the accommodating portion, and the push-up member includes a first protrusion that enters the guide hole on an outer periphery of the push-up member, and the support member has a second protrusion that enters the guide hole on an outer periphery of the support member.

(6) The feeding container according to the above (5) may further include a screw tube into which the accommodating portion is inserted, and having a groove in a peripheral wall, and be configured such that the container includes an operation portion that is operated to relatively rotate with respect to the screw tube, the groove includes a first groove into which the first protrusion of the push-up member is inserted and a second groove into which the second protrusion of the support member is inserted, and when the operation portion relatively rotate with respect to the screw tube in one direction, the first protrusion moves along the first groove, the push-up member pushes up the lid portion to open the first opening, the second protrusion moves along the second groove, and the support member moves in the axial direction to feed out the cosmetic from the first opening.

(7) The feeding container according to the above (6) may be configured such that the first groove includes a first inclination groove that extends in a first inclination direction, which is a direction inclined with respect to the axial direction, and a second inclination groove that extends in a second inclination direction which is a direction inclined with respect to both the axial direction and the first inclination direction from an end portion of the first inclination groove, the second groove includes a third inclination groove that extends in a third inclination direction which is a direction inclined with respect to the axial direction, the first inclination direction, and the second inclination direction, and an angle of the third inclination direction with respect to the axial direction is larger than an angle of the first inclination direction with respect to the axial direction and is smaller than an angle of the second inclination direction with respect to the axial direction, and the first protrusion moves from the first inclination groove toward the second inclination groove before or at the same time as the push-up member pushes up the lid portion.

(8) The feeding container according to the above (6) or (7) may be configured such that when the operation portion relatively rotate with respect to the screw tube in a direction opposite to the one direction, the second protrusion moves along the second groove, the support member moves in the axial direction, and the cosmetic is returned from the first opening, and before the support member reaches a bottom dead center which is a lowering limit of the support member, the push-up member starts moving in the axial direction toward the support member.

(9) The feeding container according to the above (6) or (7), may further include a tubular lock member configured to cover the lid portion, accommodate the screw tube, and engage with the screw tube in a synchronously rotatable manner, and be configured such that the lock member includes a second opening from which the cosmetic fed out from the first opening is exposed, a lock portion that locks the lid portion by being in contact with the lid portion, and a guide portion that protrudes inward in a radial direction of the lock member from the peripheral wall and guides the lid portion.

DESCRIPTION OF EMBODIMENTS

Figure 1:
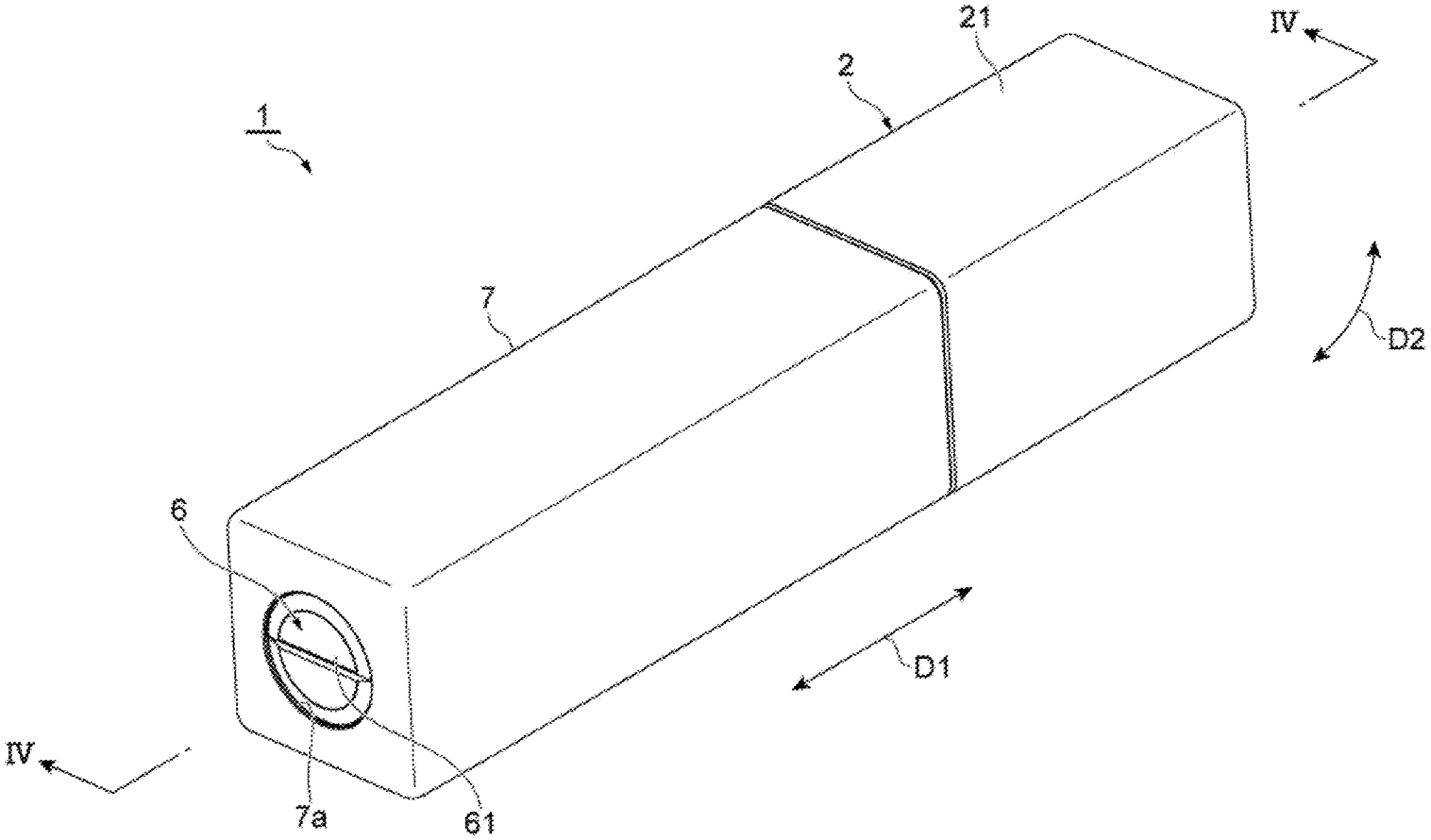
FIG. 1 is a perspective view of a feeding container.

In the cosmetic article storage container described in the background, the cosmetic tool can be exposed when a user of the cosmetic article storage container pushes up the operating pin unintentionally. When the cosmetic tool is exposed, there is a concern that an object positioned around the cosmetic article storage container is contaminated.

In the cosmetic article storage container described in the background, immediately after the operating pin starts to be pushed up, the plate member and the inner tube member are integrally pushed up with respect to the body member. At this time, when an upper end of the cosmetic tool held by the plate member is positioned above an upper end of the inner tube member, there is a concern that the cosmetic tool may contaminate the lid body.

An object of the present disclosure is to provide a feeding container capable of preventing exposure of a cosmetic against an intention of a user.

Another object of the present disclosure is to provide a feeding container capable of preventing a cosmetic from adhering to a lid portion.

Hereinafter, an embodiment of a feeding container according to the present disclosure will be described with reference to the drawings. In the description of the drawings, the same or corresponding elements are denoted by the same reference numerals, and redundant description will be appropriately omitted. For ease of understanding, some of the drawings may be shown in a simplified or exaggerated manner. Dimensional ratios and the like are not limited to those shown in the drawings.

Figure 2:
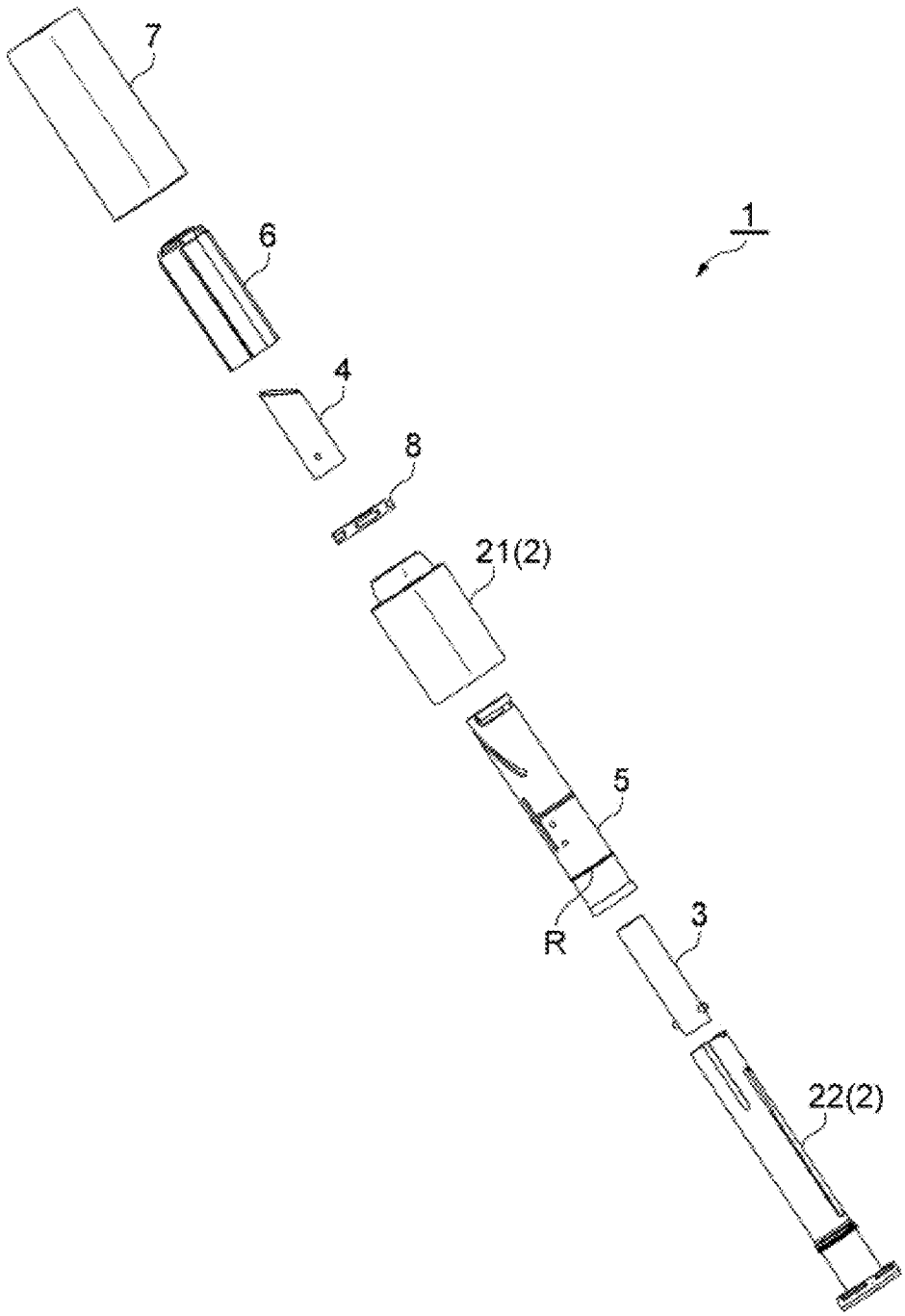
FIG. 2 is an exploded perspective view of the feeding container.

FIG. 1 is a perspective view of a feeding container 1. FIG. 2 is an exploded perspective view of the feeding container 1. The feeding container 1 is a container capable of feeding out a cosmetic M (see FIG. 3) and moving the cosmetic M back. For example, one or more a component forming the feeding container 1 have a tubular shape. Hereinafter, a direction, in which an axis of the component of the feeding container 1 extends, is referred to as an axial direction D1, and a direction along a ring around the axis of the feeding container 1 is referred to as a circumferential direction D2. Hereinafter, a state where the cosmetic M is fed out from the feeding container 1 is referred to as a "use state", a state where the cosmetic M is not exposed from the feeding container 1 and the cosmetic M is accommodated in the feeding container 1 is referred to as an "accommodating state".

The feeding container 1 includes an operation portion 21 and a lock member 7 which are portions touched by a user of the feeding container 1. The operation portion 21 and the lock member 7 are arranged in the axial direction D1. In the following description, a direction from the operation portion 21 toward the lock member 7 in the axial direction D1 may be referred to as "front," "front side," or "forward," and a direction from the lock member 7 toward the operation portion 21 in the axial direction D1 may be referred to as "rear," "rear side," or "rearward".

The feeding container 1 includes a container 2 that accommodates the cosmetic M, a support member 3 that is accommodated in the container 2 and supports the cosmetic M, a push-up member 4 that is accommodated in the container 2, a screw tube 5 to which the support member 3 and the push-up member 4 are assembled, an inner cap 6 that is connected to the screw tube 5, the lock member 7 that is positioned on the front side of the container 2, and a restriction portion 8 into which the screw tube 5 is inserted. As shown in FIG. 1, in the accommodating state, the container 2, the inner cap 6, and the lock member 7 are exposed. More specifically, the operation portion 21 of the container 2, a lid portion 61 of the inner cap 6, and the lock member 7 are exposed. The lock member 7 has a second opening 7*a*. The second opening 7*a* is positioned, for example, at a front end of the lock member 7.

Figure 3A:
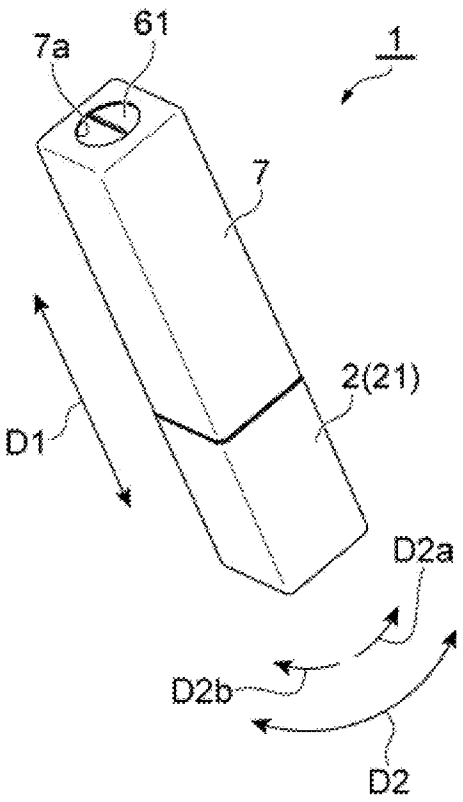
FIG. 3A is a perspective view of the feeding container in an accommodating state.
Figure 3B:
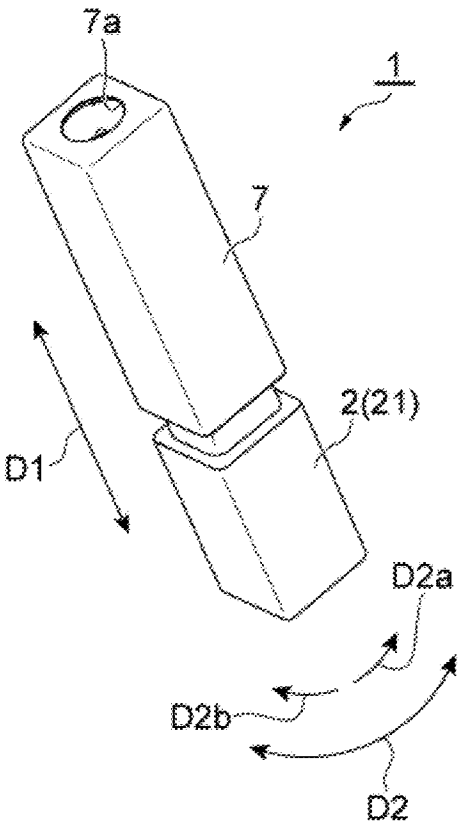
FIG. 3B is a perspective view of the feeding container in a state where a lock member is moved forward with respect to a container.
Figure 3C:
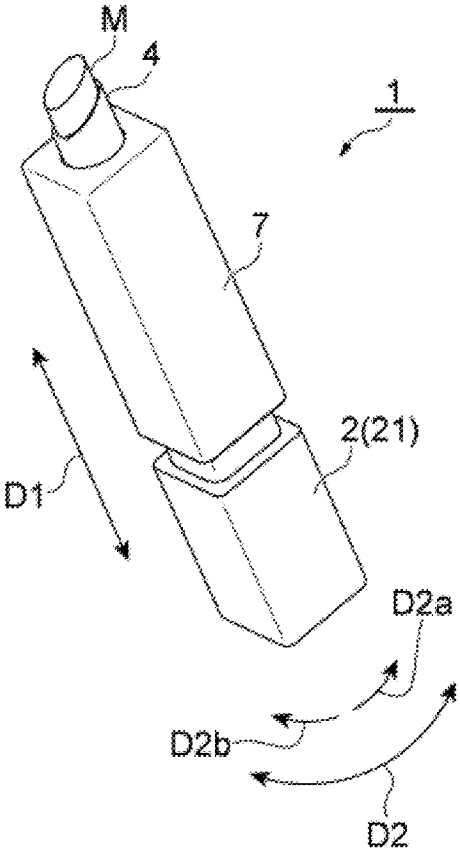
FIG. 3C is a perspective view of the feeding container in a use state.

Next, a method of using the feeding container 1 will be described with reference to FIG. 3A, FIG. 3B, and FIG. 3C. FIG. 3A is a perspective view of the feeding container 1 in the accommodating state. FIG. 3B is a perspective view of the feeding container 1 in a state where the lock member 7 is moved forward with respect to the container 2 (the operation portion 21). FIG. 3C is a perspective view of the feeding container 1 in the use state. As shown in FIG. 3A, in the accommodating state, the operation portion 21 of the container 2 and the lock member 7 are close to each other. For example, the operation portion 21 of the container 2 and the lock member 7 are in contact with each other.

In a state where the lid portion 61 closes a first opening 221*a* (see FIG. 4) to be described later, the lock member 7 locks the lid portion 61. Hereinafter, a state where the operation portion 21 of the container 2 and the lock member 7 are close to each other may be referred to as a "locked state". In the locked state, the operation portion 21 is relatively non-rotatable with respect to the lock member 7 in the circumferential direction D2. In the embodiment, "synchronous rotation" indicates that a plurality of components rotate integrally, and "relative rotation" indicates that one component rotates with respect to the other component. In the locked state, the lid portion 61 is restricted from being opened, and the lid portion 61 is exposed from the second opening 7*a*. In the locked state, the lock member 7 is in contact with the lid portion 61, and the lid portion 61 cannot be opened.

The lock member 7 is movable in the axial direction D1 with respect to the operation portion 21. Hereinafter, as shown in FIG. 3B, a state where the lock member 7 has been moved forward with respect to the operation portion 21 of the container 2 may be referred to as an "unlocked state". In the unlocked state, the operation portion 21 is relatively rotatable with respect to the lock member 7 in the circumferential direction D2. The cosmetic M is fed out by relatively rotating the operation portion 21 with respect to the lock member 7 in one direction D2*a* in the circumferential direction D2. The one direction D2*a* refers to, for example, a direction in which the operation portion 21 rotates clockwise with respect to the lock member 7 when the lock member 7 is viewed from the operation portion 21 in the axial direction D1. The cosmetic M fed out from the first opening 221*a* (see FIG. 4) described later is exposed from the second opening 7*a*. The cosmetic M fed out from the first opening 221*a* appears from the second opening 7*a*. In the unlocked state, since a space is formed between an inner surface of the front end of the lock member 7 and the lid portion 61, the lid portion 61 can be opened.

As shown in FIG. 3C, when the operation portion 21 is relatively rotated with respect to the lock member 7 in the one direction D2*a*, the cosmetic M protrudes with respect to the lock member 7. Next, a method of returning from the use state to the accommodating state and a method of returning from the unlocked state to the locked state will be described. In the use state, the cosmetic M is returned by relatively rotating the operation portion 21 in an opposite direction D2*b* with respect to the lock member 7. The opposite direction D2*b* refers to a direction opposite to the one direction D2*a*. The returned cosmetic M is housed in the second opening 7*a*. When the cosmetic M is housed in the second opening 7*a*, the feeding container 1 returns from the use state to the accommodating state. Next, by moving the lock member 7 in the axial direction D1 (rearward) so as to bring the lock member 7 close to the operation portion 21, the feeding container 1 returns from the unlocked state to the locked state.

Figure 4:
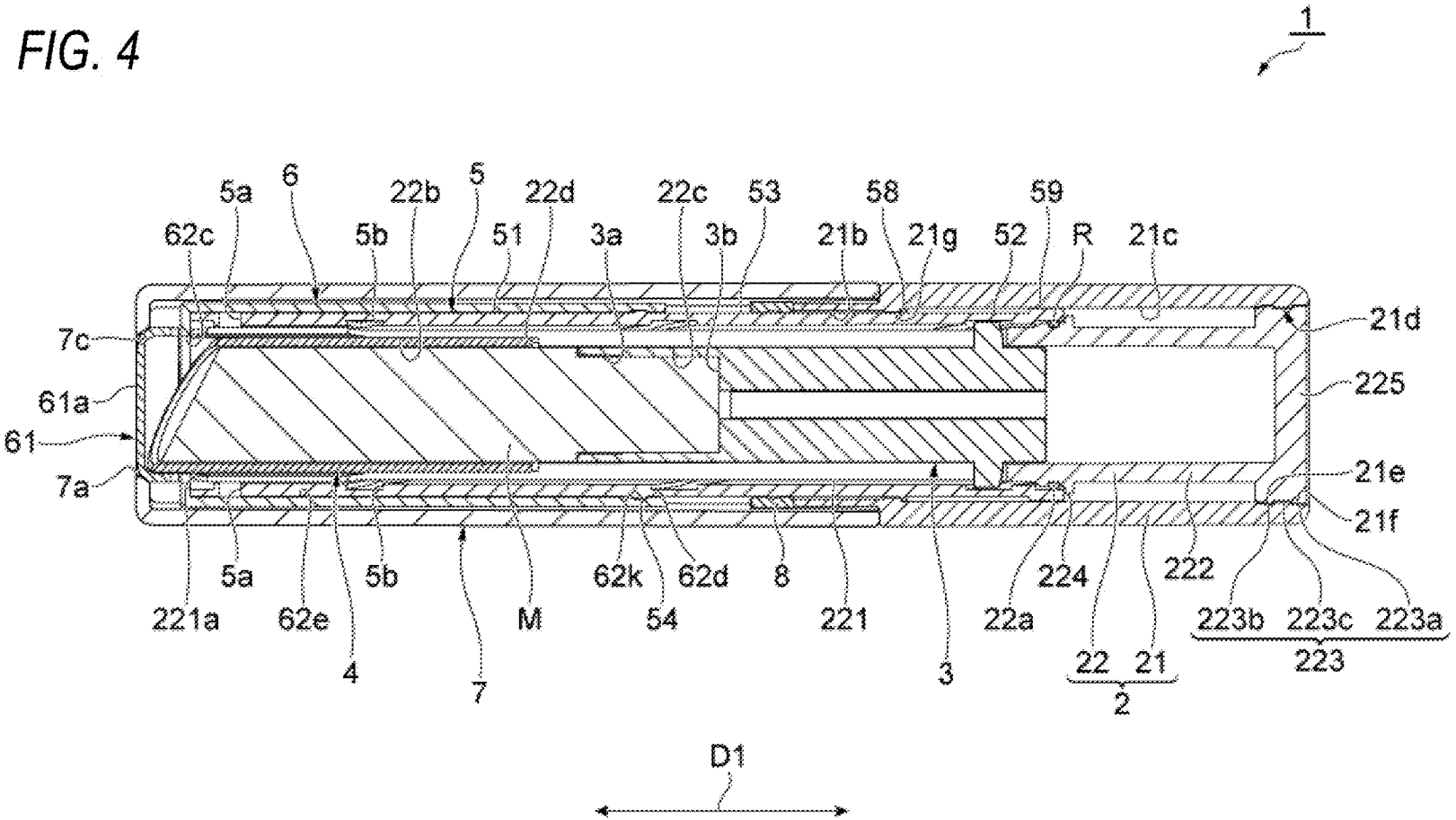
FIG. 4 is a cross-sectional view taken along a line IV-IV in FIG. 1.

Next, each configuration of the feeding container 1 and an internal structure of the feeding container 1 will be described. FIG. 4 is a cross-sectional view taken along a line IV-IV in FIG. 1, and shows the feeding container 1 that is in the locked state and in the accommodating state. For example, the container 2 includes the operation portion 21 which is operated to relatively rotate with respect to the lock member 7 to feed out the cosmetic M, and an accommodating tube 22 which is inserted into the operation portion 21. The support member 3 and the push-up member 4 are accommodated inside the accommodating tube 22. For example, in the accommodating state, the support member 3 is positioned rearward the push-up member 4. For example, the inner cap 6 is disposed inside the lock member 7, and the screw tube 5 is disposed inside the inner cap 6.

For example, the operation portion 21 is separate from the accommodating tube 22. However, the operation portion 21 may be integrated with the accommodating tube 22. For example, the operation portion 21 has a tubular shape, and the accommodating tube 22 is accommodated inside the operation portion 21. An insertion space into which the screw tube 5 is inserted is formed between the operation portion 21 and the accommodating tube 22. For example, a portion on the rear side of the screw tube 5 is inserted into the insertion space. The accommodating tube 22 is accommodated inside the screw tube 5.

Figure 5:
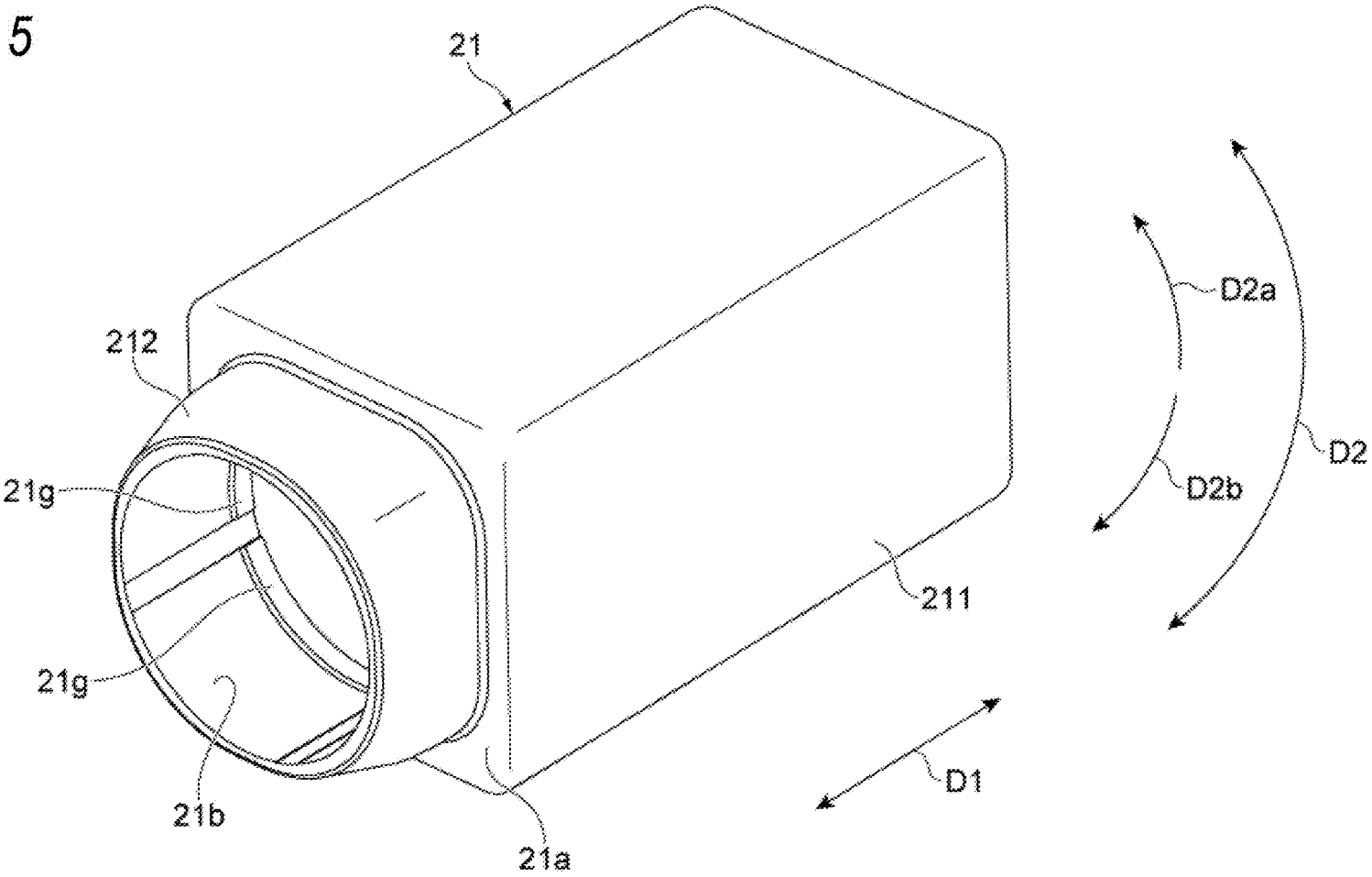
FIG. 5 is a perspective view of an operation portion.
Figure 6:
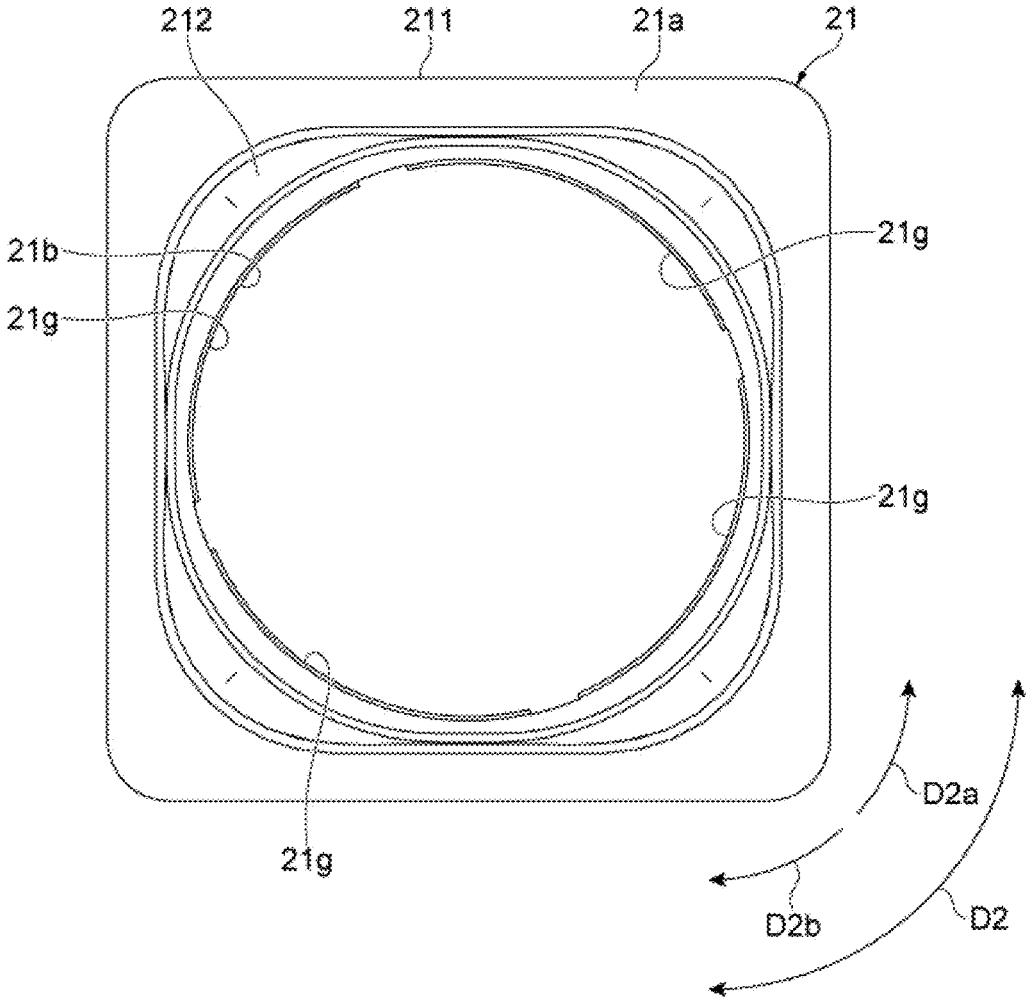
FIG. 6 is a front view of the operation portion.

The operation portion 21 surrounds a portion of the accommodating tube 22. For example, the operation portion 21 surrounds a portion on the rear side of the accommodating tube 22. FIG. 5 is a perspective view of the operation portion 21. FIG. 6 is a front view of the operation portion 21. As shown in FIGS. 4, 5, and 6, the operation portion 21 includes a main portion 211 which is a portion pinched by the user when operating the operation portion 21, and a neck portion 212 which extends to the front side from the main portion 211. The main portion 211 extends along the axial direction D1. The main portion 211 has a non-circular shape when viewed from the axial direction D1. For example, the main portion 211 has a rectangular shape. For example, when viewed along the axial direction D1, a shape of the main portion 211 has a polygonal shape with rounded corners. For example, the shape of the main portion 211 has a corner-rounded square shape. In this case, it is possible to prevent sliding of fingers with respect to the main portion 211 and easily pinch the main portion 211 with the fingers.

A length of the neck portion 212 in the axial direction D1 is shorter than a length of the main portion 211 in the axial direction D1. A rear end of the neck portion 212 has a non-circular shape when viewed from the axial direction D1. For example, the rear end of the neck portion 212 has a rectangular shape. A front end of the neck portion 212 has a rectangular shape whose roundness of the corner is larger than that of the rear end of the neck portion 212 when viewed from the axial direction D1. The shape approximates a circular shape, but may be a circular shape. Accordingly, smooth transition from the unlocked state to the locked state can be achieved. The neck portion 212 has an outer peripheral surface extending from the rear end of the neck portion 212 toward the front end of the neck portion 212. When viewed from the axial direction D1, an area of a portion surrounded by the outer peripheral surface of the neck portion 212 is smaller than an area of a portion surrounded by the outer peripheral surface of the main portion 211. The operation portion 21 has a step portion 21*a* between the front end of the outer peripheral surface of the main portion 211 and the rear end of the outer peripheral surface of the neck portion 212, which protrudes radially outward of the neck portion 212 from the rear end of the outer peripheral surface of the neck portion 212.

The operation portion 21 includes a front inner peripheral surface 21*b*, a rear inner peripheral surface 21*c*, and a fitting portion 21*d*, each of which defines a through hole that penetrates the operation portion 21 along the axial direction D1. The front inner peripheral surface 21*b* extends rearward from a front end of the operation portion 21. The fitting portion 21*d* is provided at a rear end of the operation portion 21. The rear inner peripheral surface 21*c* is disposed between the front inner peripheral surface 21*b* and the fitting portion 21*d*. For example, the front inner peripheral surface 21*b* has a circular shape when viewed from the axial direction D1. For example, the rear inner peripheral surface 21*c* and the fitting portion 21*d* have a rectangular shape when viewed from the axial direction D1. An inner diameter of the front inner peripheral surface 21*b* is smaller than a length of the rear inner peripheral surface 21*c* intersecting the axial direction D1. The operation portion 21 includes an inner peripheral surface protruding portion 21*g* on the front inner peripheral surface 21*b*. For example, the inner peripheral surface protruding portion 21*g* is a protruding portion extending along the circumferential direction D2 so as to protrude radially inward on the front inner peripheral surface 21*b*. The operation portion 21 includes a plurality of (for example, four) inner peripheral surface protruding portions 21*g*. The plurality of inner peripheral surface protruding portions 21*g* are arranged along the circumferential direction D2, and are disposed at intervals. The inner peripheral surface protruding portion 21*g* is positioned at a rear end of the front inner peripheral surface 21*b*.

The fitting portion 21*d* includes a recessed portion 21*e* positioned at a front end of the fitting portion 21*d* and an opening portion 21*f* positioned at a rear end of the fitting portion 21*d*. The recessed portion 21*e* is, for example, a recessed portion recessed radially outward of the neck portion 212. The fitting portion 21*d* includes four recessed portions 21*e*. As viewed from the axial direction D1, one recessed portion 21*e* is provided on each side of a rectangle forming an inner contour of the fitting portion 21*d*. The opening portion 21*f* forms a step protruding radially outward.

Figure 7:
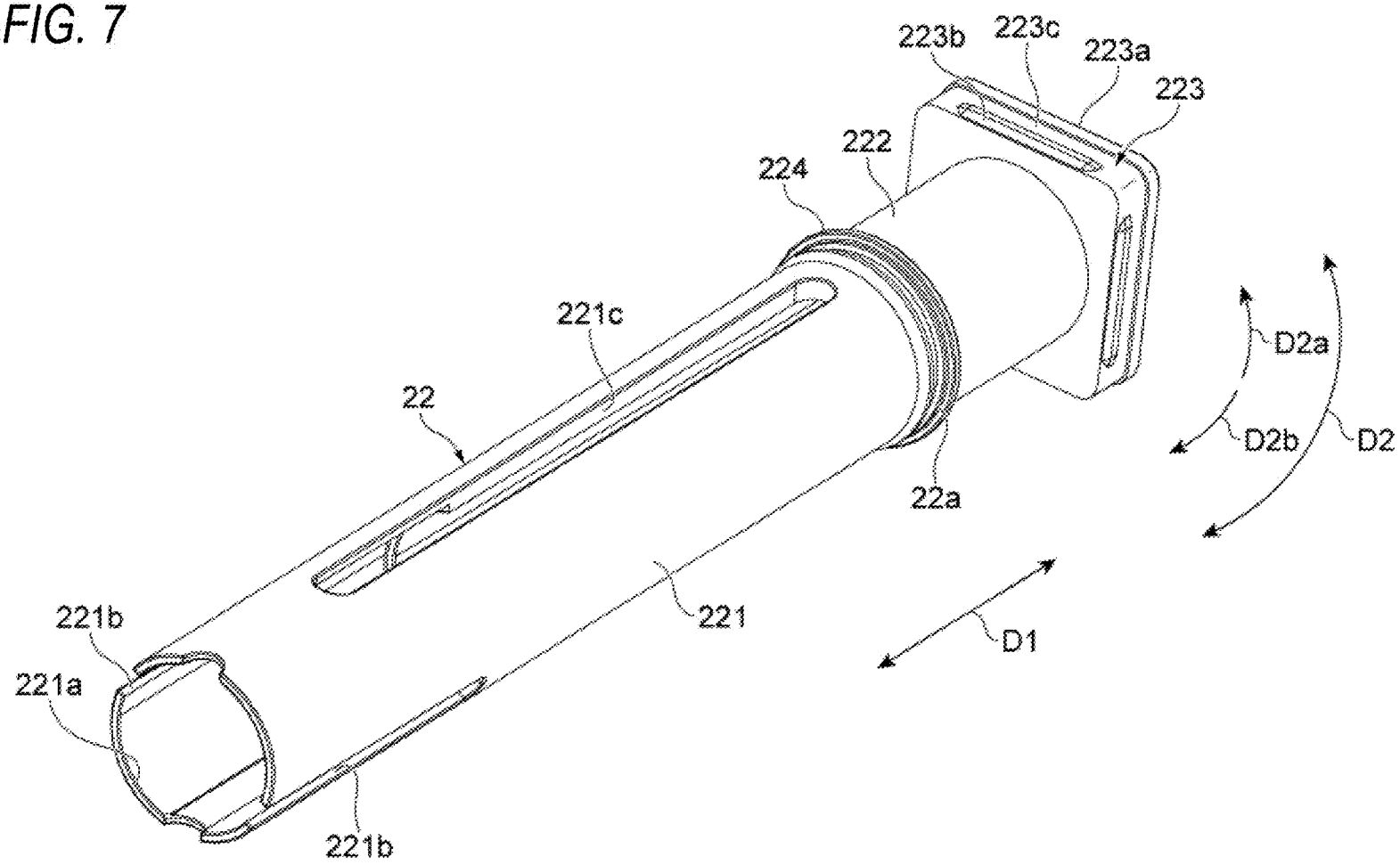
FIG. 7 is a perspective view of an accommodating tube.
Figure 8:
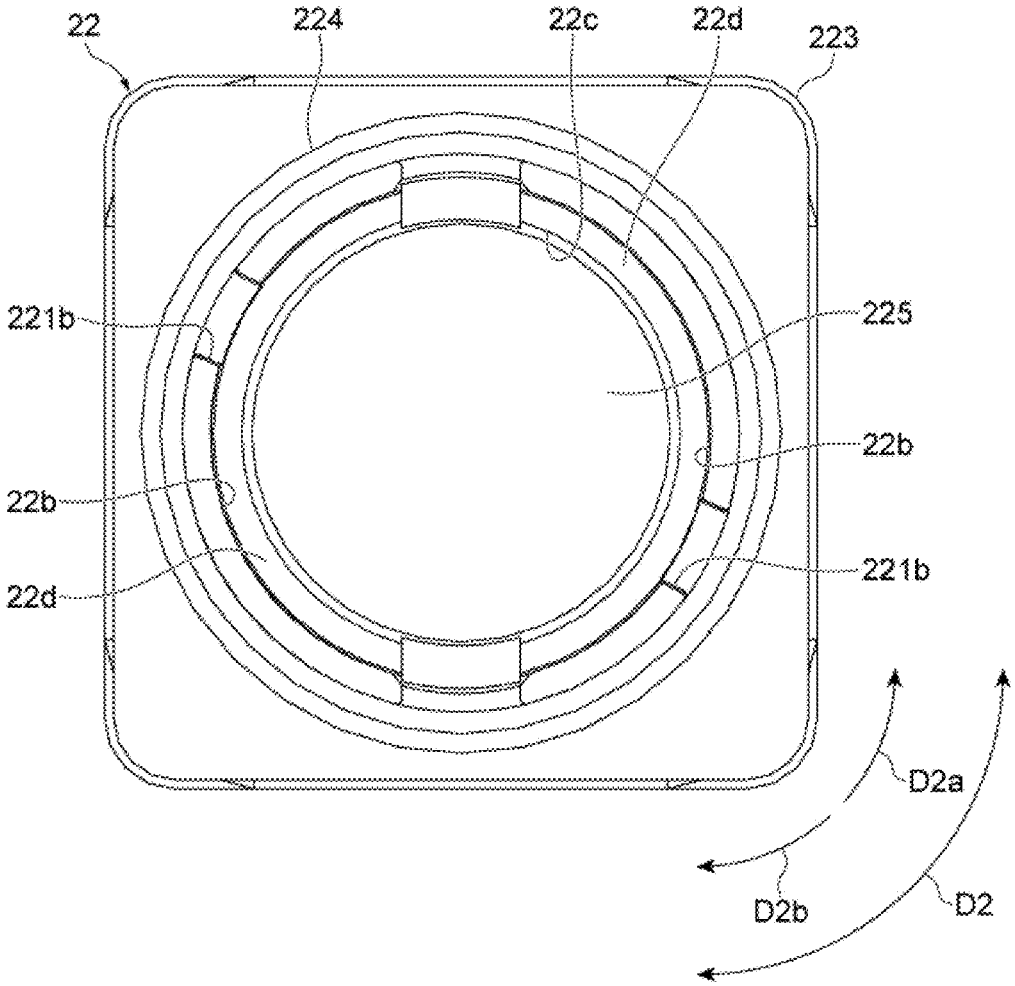
FIG. 8 is a front view of the accommodating tube.

FIG. 7 is a perspective view of the accommodating tube 22. FIG. 8 is a front view of the accommodating tube 22. As shown in FIGS. 4, 7, and 8, the accommodating tube 22 includes an accommodating portion 221 that accommodates the cosmetic M, an insertion portion 222 that is a portion to be inserted into the operation portion 21, and a fitting portion 223 that extends rearward from a rear end of the insertion portion 222. Further, the accommodating tube 22 includes an accommodating tube protruding portion 224 provided at a boundary between the accommodating portion 221 and the insertion portion 222, and a rear end portion 225 closing a rear end of the accommodating tube 22. The accommodating portion 221 has a tubular shape. The accommodating portion 221 has, for example, a cylindrical shape. An axis of the accommodating portion 221 extends along the axial direction D1. An outer diameter of the accommodating portion 221 is smaller than the inner diameter of the front inner peripheral surface 21*b* of the operation portion 21.

The accommodating portion 221 has a first opening 221*a* from which the cosmetic M is exposed. The first opening 221*a* is positioned at a front end of the accommodating portion 221. The accommodating portion 221 includes first guide holes 221*b* and a second guide hole 221*c* formed at a position different from the first guide holes 221*b*. The first guide hole 221*b* and the second guide hole 221*c* penetrate the accommodating portion 221. Each of the first guide hole 221*b* and the second guide hole 221*c* extends along the axial direction D1.

The first guide hole 221*b* extends rearward from the front end of the accommodating portion 221. An opening of the first guide hole 221*b* may be formed at the front end of the accommodating portion 221. For example, the first guide hole 221*b* is a notch formed in the accommodating portion 221. The accommodating portion 221 includes a pair of first guide holes 221*b*. The pair of first guide holes 221*b* are disposed at positions sandwiching the axis of the accommodating tube 22.

The second guide hole 221*c* is positioned closer to a rear end of the accommodating portion 221 than the first guide hole 221*b*. For example, a distance from the second guide hole 221*c* to the rear end of the accommodating portion 221 is shorter than a distance from the second guide hole 221*c* to the front end of the accommodating portion 221. A front end of the second guide hole 221*c* is positioned forward of a rear end of the first guide hole 221*b*. A length of the second guide hole 221*c* in the axial direction D1 is longer than a length of the first guide hole 221*b* in the axial direction D1. The accommodating portion 221 includes a pair of second guide holes 221*c*. The pair of second guide holes 221*c* are disposed at positions sandwiching the axis of the accommodating tube 22.

The insertion portion 222 extends rearward from the rear end of the accommodating portion 221. The insertion portion 222 has, for example, a cylindrical shape. An outer diameter of the insertion portion 222 is equal to or smaller than an inner diameter of the rear inner peripheral surface 21*c* of the operation portion 21.

The fitting portion 223 is fitted to the fitting portion 21*d* of the operation portion 21. The fitting portion 223 has a rectangular shape surrounding the insertion portion 222 when viewed from the axial direction D1. The fitting portion 223 has a thickness along the axial direction D1. The fitting portion 223 includes a step portion 223*a* positioned on a rear end side of the fitting portion 223, a protruding portion 223*b* positioned on a front end side of the fitting portion 223, and a recessed portion 223*c* forming a side surface of the fitting portion 223. The recessed portion 223*c* is a portion recessed as compared with the step portion 223*a* and the protruding portion 223*b*. The step portion 223*a* surrounds the recessed portion 223*c* when viewed from the axial direction D1. The step portion 223*a* is fitted into the opening portion 21*f*. The protruding portion 223*b* is provided to protrude radially outward from the recessed portion 223*c*. Each protruding portion 223*b* enters the corresponding recessed portion 21*e*.

The accommodating tube protruding portion 224 extends in the circumferential direction D2 at the boundary between the accommodating portion 221 and the insertion portion 222. The accommodating tube protruding portion 224 is disposed so as to be in contact with a rear end of the screw tube 5, and prevents the screw tube 5 from moving rearward. For example, the accommodating tube protruding portion 224 has a circular ring shape when viewed from the axial direction D1. The rear end portion 225 has, for example, a rectangular shape. For example, a length (thickness) of the rear end portion 225 in the axial direction D1 is slightly shorter than a length of the fitting portion 223 in the axial direction D1.

The accommodating tube 22 has a groove 22*a* provided at the rear end of the accommodating portion 221. The groove 22*a* extends, for example, in the circumferential direction D2. As an example, the groove 22*a* extends over the entire circumference of the accommodating tube 22. An outer diameter of the accommodating tube 22 in the groove 22*a* is smaller than the outer diameter of the accommodating portion 221 and the outer diameter of the insertion portion 222. An O-ring R is disposed in the groove 22*a*. The O-ring R is formed of an elastic member. The O-ring R surrounds the accommodating tube 22 so as to fill the groove 22*a*. The O-ring R imparts an appropriate rotational resistance to the relative rotation between the accommodating tube 22 and the screw tube 5. The user can feel a good feeling and a high-grade feeling accompanying the rotation operation.

For example, the accommodating tube 22 may include a front inner peripheral surface 22*b* extending rearward from a front end of the accommodating tube 22, and a rear inner peripheral surface 22*c* extending from the front inner peripheral surface 22*b* to the rear end portion 225. In this case, an inner diameter of the front inner peripheral surface 22*b* may be larger than an inner diameter of the rear inner peripheral surface 22*c*. The accommodating tube 22 may include a step portion 22*d* between a rear end of the front inner peripheral surface 22*b* and a front end of the rear inner peripheral surface 22*c*, which protrudes radially inward of the accommodating tube 22 from a rear end of the front inner peripheral surface 22*b*. The step portion 22*d* may extend along the circumferential direction D2.

A configuration in which the accommodating tube 22 is connected to the operation portion 21 will be described. The insertion portion 222 of the accommodating tube 22 is inserted into an internal space of the operation portion 21 formed by the rear inner peripheral surface 21*c*. The fitting portion 223 of the accommodating tube 22 is fitted to the fitting portion 21*d* of the operation portion 21. More specifically, when the protruding portion 223*b* of the fitting portion 223 enters the recessed portion 21*e* of the operation portion 21, the fitting portion 223 is fitted to the fitting portion 21*d*. Accordingly, the accommodating tube 22 is engaged with the operation portion 21 in the axial direction D1. The fitting portion 223 and the fitting portion 21*d* have a non-circular shape when viewed from the axial direction D1. Therefore, when the fitting portion 223 of the accommodating tube 22 enters the fitting portion 21*d*, the accommodating tube 22 is engaged with the operation portion 21 in the circumferential direction D2 and is rotatable synchronously with the operation portion 21.

Figure 9:
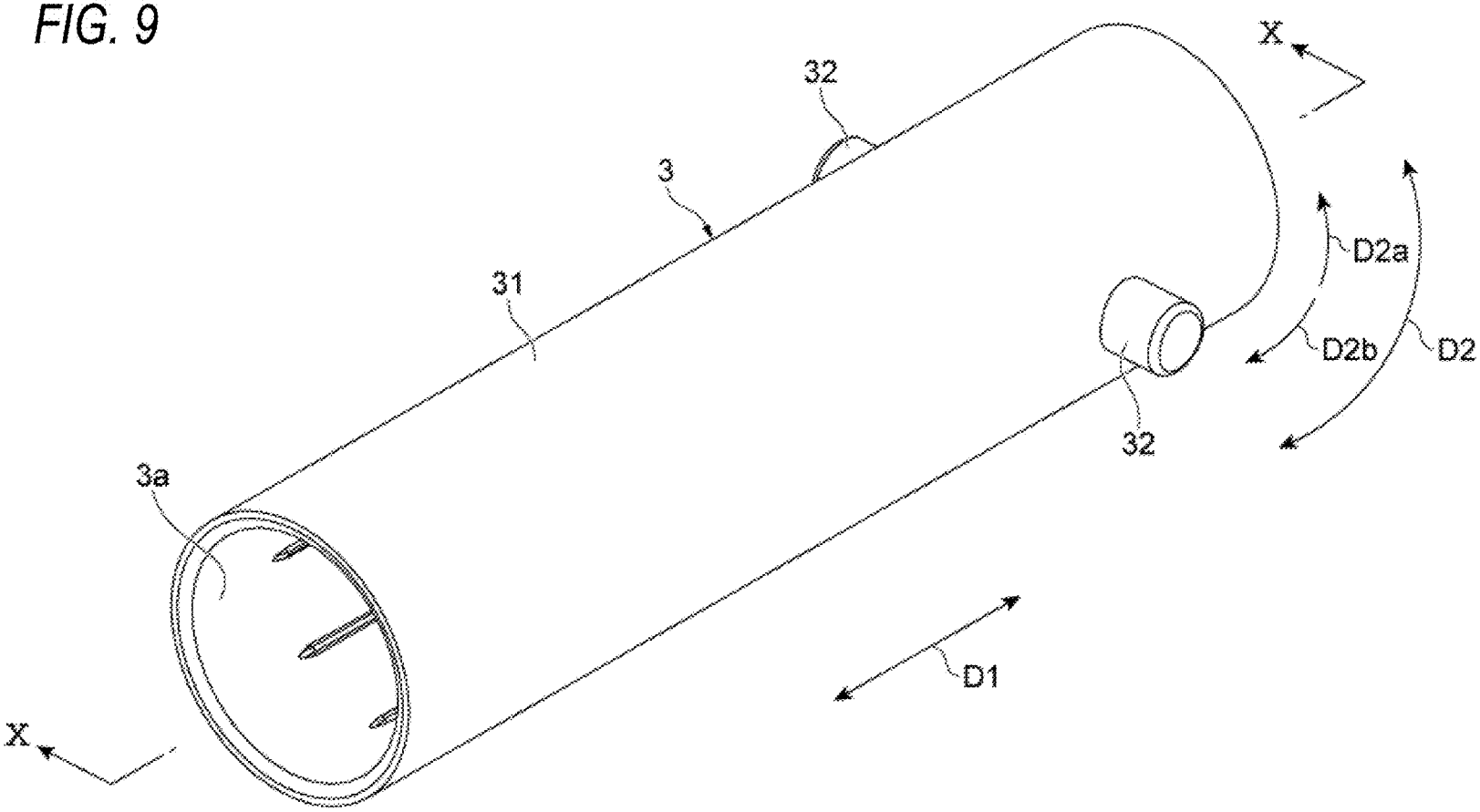
FIG. 9 is a perspective view of a support member.
Figure 10:
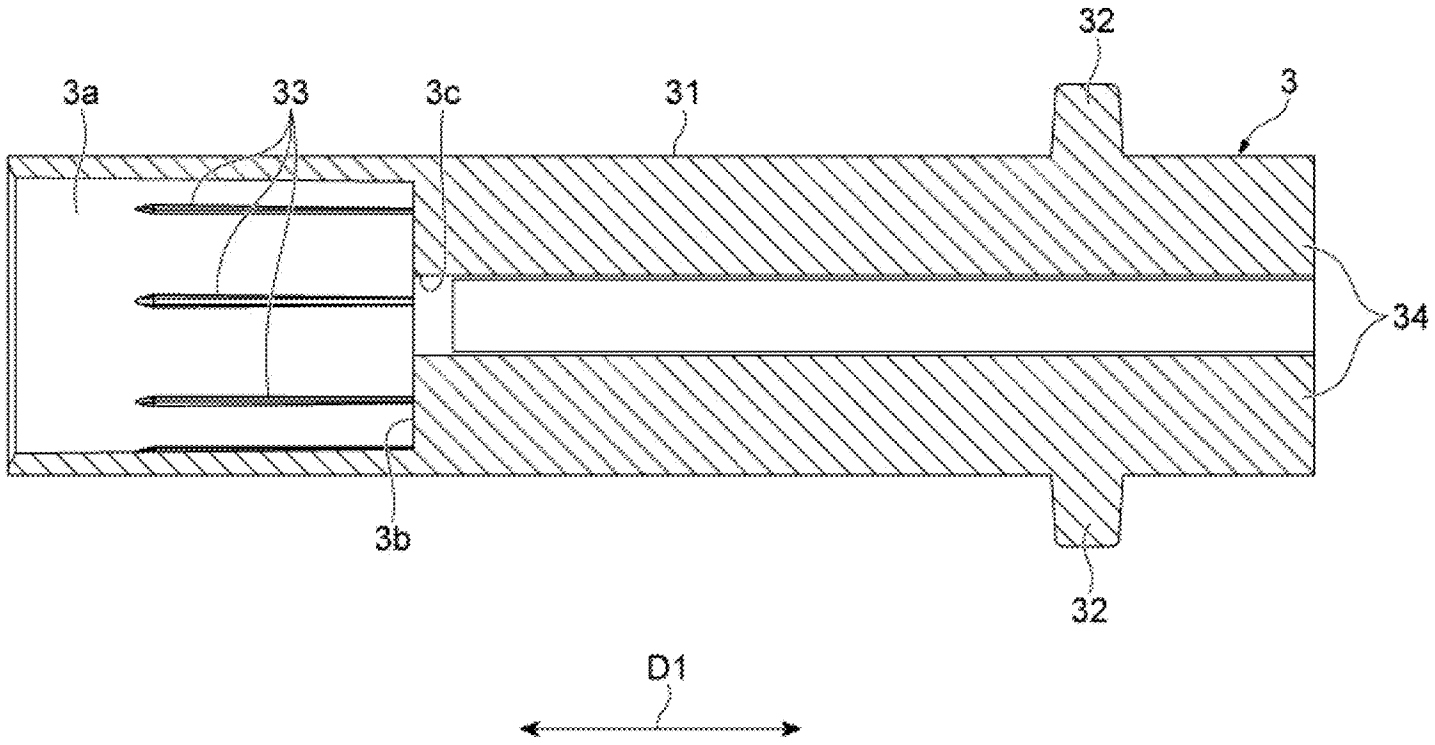
FIG. 10 is a cross-sectional view taken along a line X-X in FIG. 9.

Next, the support member 3 will be described. FIG. 9 is a perspective view of the support member 3. FIG. 10 is a cross-sectional view taken along a line X-X in FIG. 9. As shown in FIGS. 4, 9, and 10, the support member 3 is accommodated inside the accommodating tube 22. The support member 3 supports the cosmetic M. The support member 3 includes a main body portion 31 having a tubular shape and second protrusions 32 provided on an outer peripheral surface of the main body portion 31. For example, the main body portion 31 has a cylindrical shape. The cosmetic M is accommodated inside the main body portion 31. More specifically, in a state where the cosmetic M protrudes from an opening of a front end of the main body portion 31, a portion on a rear side of the cosmetic M is accommodated in the main body portion 31.

The second protrusion 32 enters the second guide hole 221*c* (see FIG. 7) of the accommodating tube 22. The second protrusion 32 has a pillar shape (columnar shape as an example). For example, the second protrusion 32 protrudes radially outward of the main body portion 31 from the outer peripheral surface of the main body portion 31. The support member 3 includes, for example, a pair of second protrusions 32. The pair of second protrusions 32 are disposed at positions sandwiching an axis of the main body portion 31. When the second protrusion 32 moves along the second guide hole 221*c*, the support member 3 is movable in the axial direction D1 inside the accommodating tube 22. The support member 3 is engaged with the container 2 (the accommodating portion 221) in the circumferential direction D2 as the second protrusion 32 enters the second guide hole 221*c*. The support member 3 is rotatable synchronously with the accommodating tube 22 of the container 2.

The support member 3 includes an accommodating portion 3*a* in which the cosmetic M is accommodated. The accommodating portion 3*a* is, for example, a portion of an inner peripheral surface of the support member 3. The accommodating portion 3*a* has, for example, a circular shape when viewed from the axial direction D1. For example, a length of the accommodating portion 3*a* in the axial direction D1 is shorter than half the length of the support member 3 in the axial direction D1. The support member 3 includes a bottom portion 3*b* provided at a rear end of the accommodating portion 3*a*. The cosmetic M accommodated in the accommodating portion 3*a* is in contact with, for example, the bottom portion 3*b*. The support member 3 includes a claw portion 33 provided in the accommodating portion 3*a*. The claw portion 33 bites into the cosmetic M accommodated in the accommodating portion 3*a*. Since the claw portion 33 bites into the cosmetic M, the cosmetic M can be firmly supported by the support member 3. The claw portion 33 extends, for example, along the axial direction D1. The claw portion 33 protrudes radially inward of the main body portion 31 in the accommodating portion 3*a*.

The support member 3 has an opening 3*c* provided in the bottom portion 3*b*. The opening 3*c* penetrates the bottom portion 3*b* in the axial direction D1. For example, a center of the opening 3*c* overlaps an axis of the support member 3. When the cosmetic M is accommodated in the accommodating portion 3*a*, the cosmetic M can be easily pushed into the bottom portion 3*b* as air present between the cosmetic M and the bottom portion 3*b* comes out of the opening 3*c*.

For example, the support member 3 may include ribs 34 extending from the bottom portion 3*b* to a rear end of the main body portion 31. For example, the ribs 34 extend from an inner peripheral surface of the bottom portion 3*b* to an outer peripheral surface of the bottom portion 3*b* when viewed from the axial direction D1. The support member 3 may include a pair of ribs 34. The pair of ribs 34 may be disposed at positions sandwiching the axis of the main body portion 31.

Figure 11:
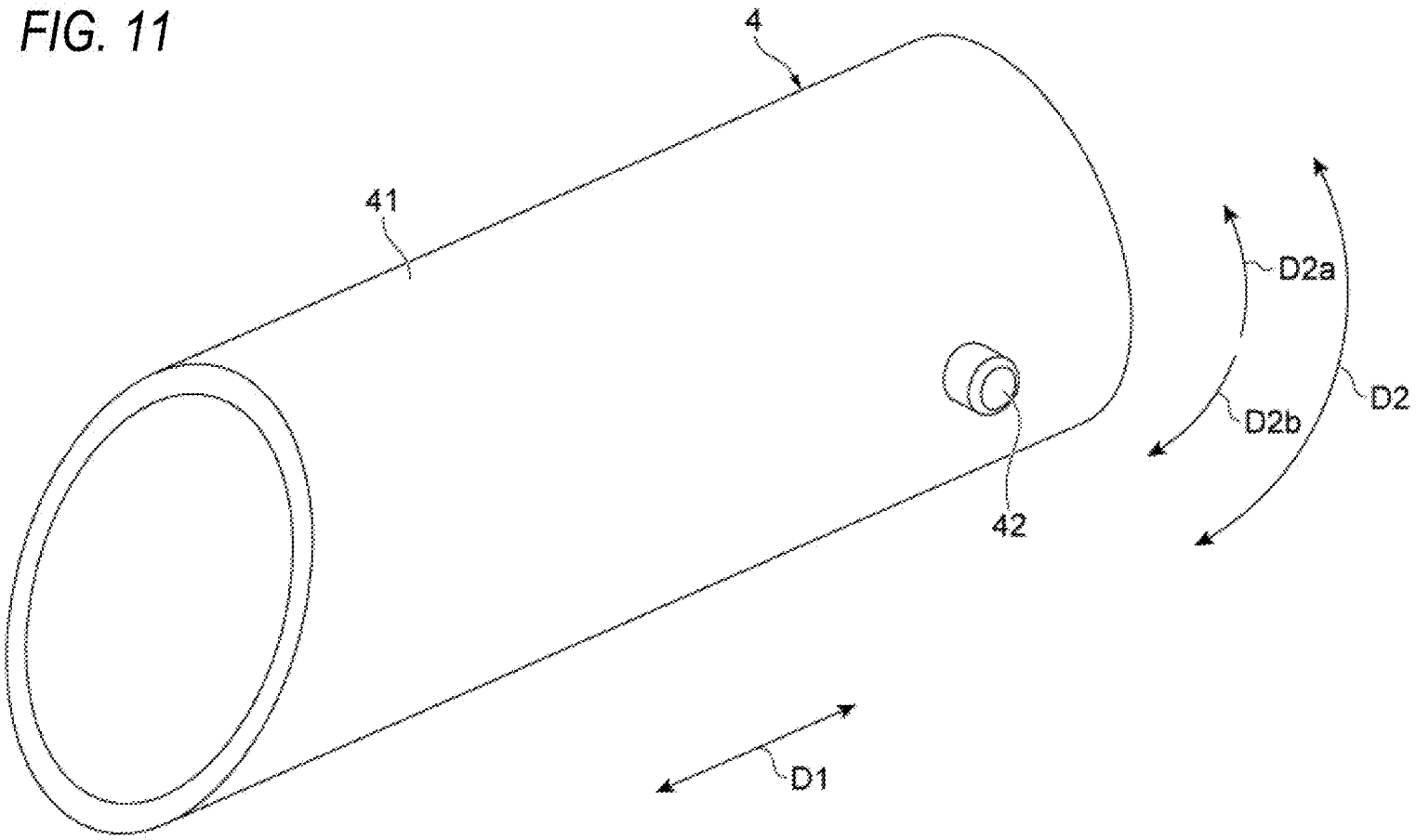
FIG. 11 is a perspective view of a push-up member.

FIG. 11 is a perspective view of the push-up member 4. As shown in FIGS. 4 and 11, the push-up member 4 is accommodated inside the accommodating portion 221 in the accommodating tube 22. The push-up member 4 is positioned on a front side of the accommodating tube 22. The push-up member 4 has a tubular shape into which the cosmetic M enters. More specifically, the push-up member 4 includes a main body portion 41 having a tubular shape (a cylindrical shape as an example) and a first protrusion 42 provided on an outer peripheral surface of the main body portion 41. Both ends of the main body portion 41 in the axial direction D1 are open. An inner diameter of the main body portion 41 is larger than an outer diameter of the cosmetic M. The cosmetic M can enter the main body portion 41. An opening surface of the opening at a front end of the main body portion 41 may be inclined with respect to a plane orthogonal to the axial direction D1. An opening surface of the opening at a rear end of the main body portion 41 extends along a plane orthogonal to the axial direction D1.

The first protrusion 42 enters the first guide hole 221*b* (see FIG. 7) of the accommodating tube 22. The first protrusion 42 has a pillar shape. For example, the first protrusion 42 has a columnar shape. For example, the first protrusion 42 protrudes radially outward of the main body portion 41 from the outer peripheral surface of the main body portion 41. The push-up member 4 includes, for example, a pair of first protrusions 42. The pair of first protrusions 42 are disposed at positions sandwiching an axis of the main body portion 41. When the first protrusion 42 moves along the first guide hole 221*b*, the push-up member 4 is movable in the axial direction D1 inside the accommodating tube 22. The push-up member 4 is engaged with the container 2 (the accommodating portion 221) in the circumferential direction D2 as the first protrusion 42 enters the first guide hole 221*b*. The push-up member 4 is rotatable synchronously with the accommodating tube 22 of the container 2.

Figure 12:
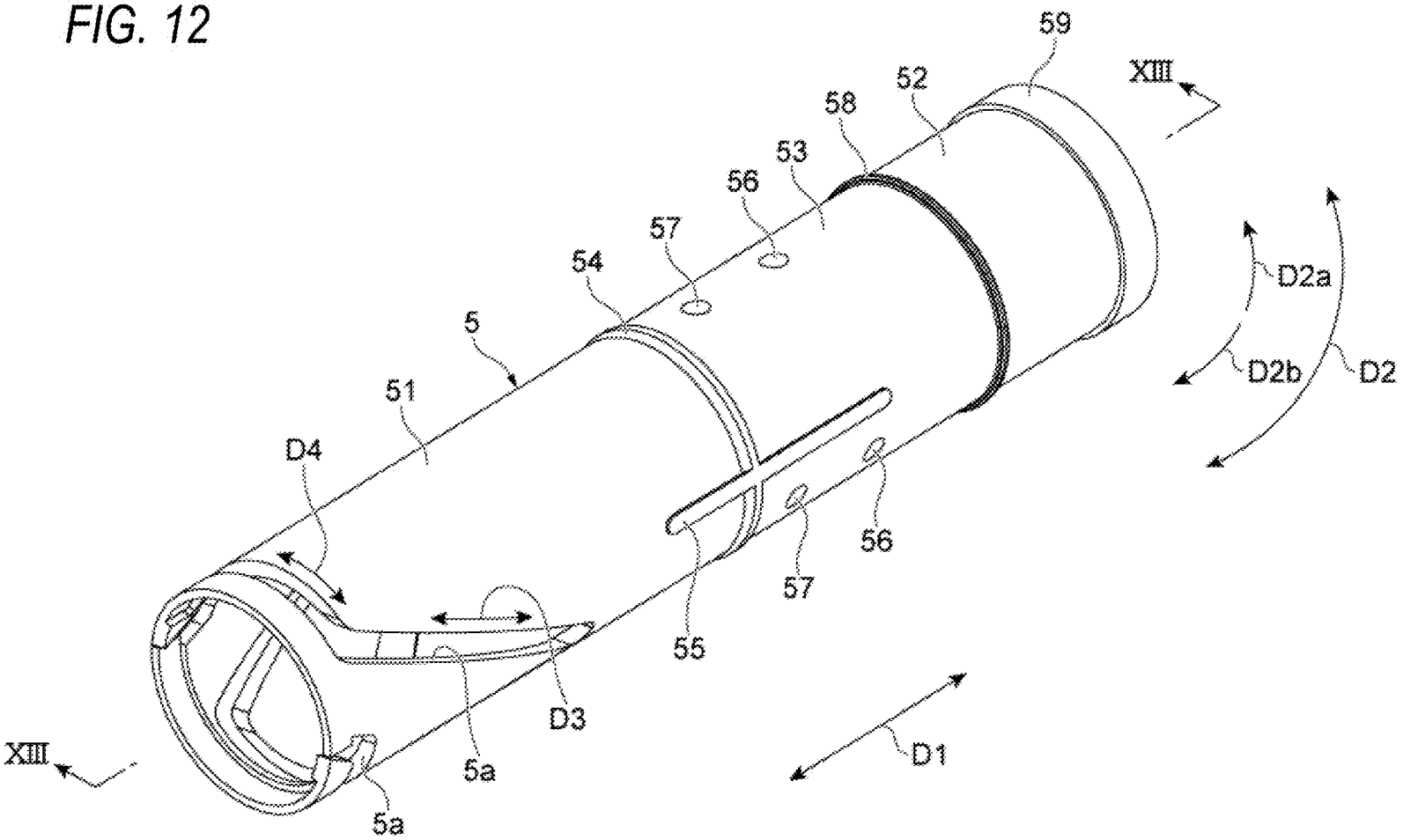
FIG. 12 is a perspective view of a screw tube.
Figure 13:
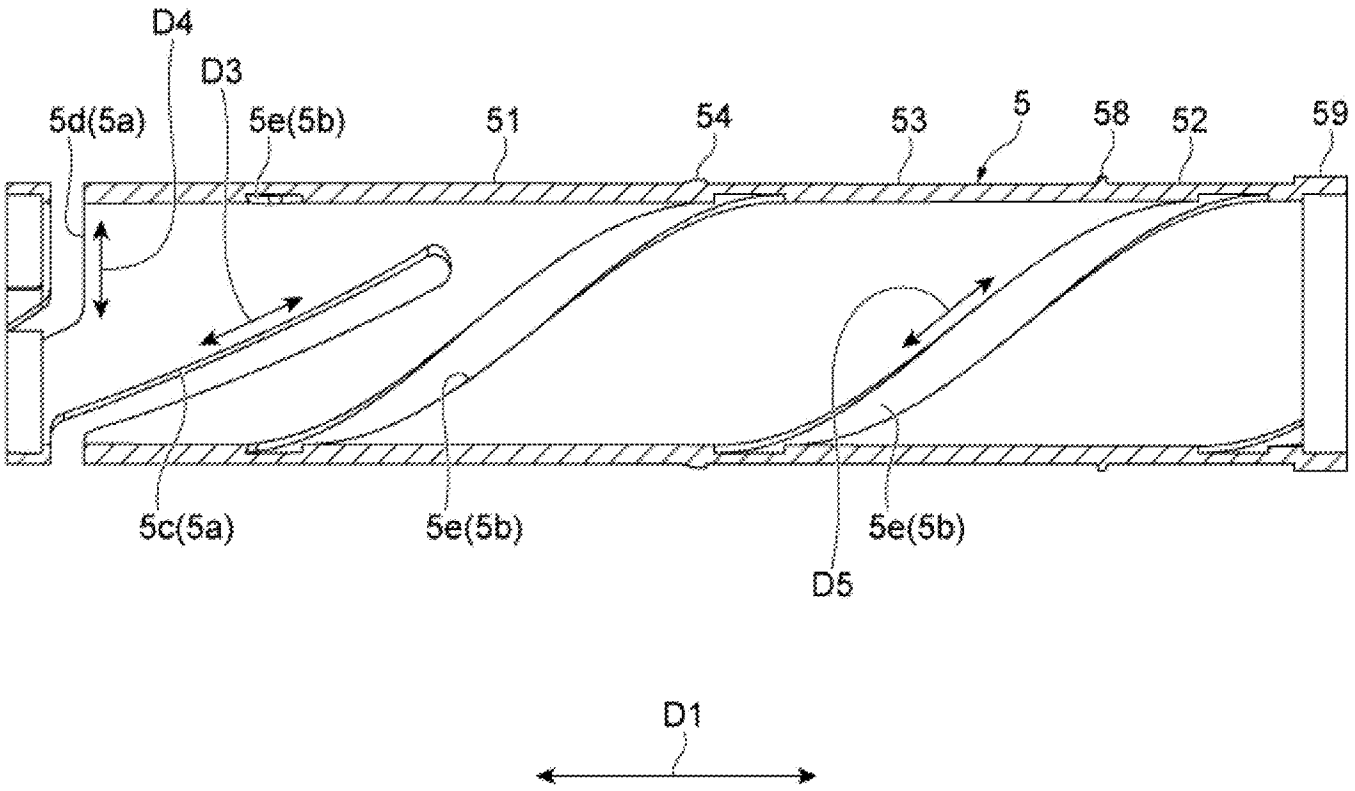
FIG. 13 is a cross-sectional view taken along a line XIII-XIII in FIG. 12.

FIG. 12 is a perspective view of the screw tube 5. FIG. 13 is a cross-sectional view taken along a line XIII-XIII in FIG. 12. As shown in FIGS. 4, 12, and 13, the screw tube 5 accommodates the accommodating portion 221 of the accommodating tube 22. The accommodating portion 221 is inserted into the screw tube 5. The screw tube 5 has, for example, a cylindrical shape. The screw tube 5 includes a front insertion portion 51 to be inserted into the inner cap 6, a rear insertion portion 52 to be inserted into the operation portion 21, and an intermediate portion 53 positioned between the front insertion portion 51 and the rear insertion portion 52. The front insertion portion 51, the rear insertion portion 52, and the intermediate portion 53 have, for example, a cylindrical shape.

The screw tube 5 includes an annular protruding portion 54 extending along the circumferential direction D2 and a protruding portion 55 extending along the axial direction D1. The annular protruding portion 54 is positioned at a boundary portion between the front insertion portion 51 and the intermediate portion 53. The annular protruding portion 54 and the protruding portion 55 protrude radially outward of the screw tube 5 on an outer peripheral surface of the screw tube 5. The protruding portion 55 intersects the annular protruding portion 54. For example, the protruding portion 55 crosses the annular protruding portion 54 in the axial direction D1. The protruding portion 55 is provided so as to bridge over the front insertion portion 51 and the intermediate portion 53.

The screw tube 5 includes protruding portions 56 and 57 provided on an outer peripheral surface of the intermediate portion 53. The protruding portions 57 are provided near a front end of the rear insertion portion 52. The protruding portions 56 and the protruding portions 57 are arranged along the axial direction D1. The protruding portions 56 are positioned behind the protruding portions 57. The protruding portions 56 and 57 protrude from an outer peripheral surface of the rear insertion portion 52. For example, the protruding portions 56 and 57 have an elliptical shape when viewed radially from outside of the screw tube 5. For example, a protruding amount of each of the protruding portions 56 and 57 with respect to the outer peripheral surface of the rear insertion portion 52 increases toward a center of each of the protruding portions 56 and 57. The protruding portion 56 has the same shape as the protruding portion 57. The screw tube 5 includes three protruding portions 56 and three protruding portions 57 arranged in the circumferential direction D2.

The screw tube 5 includes a flange portion 58 positioned between the rear insertion portion 52 and the intermediate portion 53. The flange portion 58 is, for example, an annular protruding portion extending along the circumferential direction D2. An outer diameter of the flange portion 58 is larger than an outer diameter of the intermediate portion 53 and an outer diameter of the rear insertion portion 52. A protruding amount of the flange portion 58 radially outward with respect to the rear insertion portion 52 and the intermediate portion 53 is larger than the protruding amount of the protruding portion 57 with respect to the outer peripheral surface of the rear insertion portion 52. The outer diameter of the flange portion 58 is larger than an inner diameter of the inner peripheral surface protruding portion 21*g*. When the flange portion 58 is in contact with the inner peripheral surface protruding portion 21*g* along the axial direction D1, the screw tube 5 is restricted from moving forward with respect to the operation portion 21.

The screw tube 5 includes a diameter enlarged portion 59 positioned at a rear end of the rear insertion portion 52. The diameter enlarged portion 59 has a cylindrical shape. For example, an inner diameter of the diameter enlarged portion 59 is larger than an inner diameter of the rear insertion portion 52. An outer diameter of the diameter enlarged portion 59 is smaller than the inner diameter of the rear inner peripheral surface 21*c*. The O-ring R is in contact with an inner peripheral surface of the diameter enlarged portion 59. When the diameter enlarged portion 59 is in contact with the accommodating tube protruding portion 224, the screw tube 5 is restricted from moving rearward with respect to the accommodating tube 22. The screw tube 5 is engaged with the container 2 in the axial direction D1 by the contact between the flange portion 58 and the inner peripheral surface protruding portion 21*g* and the contact between the diameter enlarged portion 59 and the accommodating tube protruding portion 224.

The screw tube 5 has a groove in a peripheral wall. The groove provided in the peripheral wall of the screw tube 5 includes a first groove 5*a* into which the first protrusion 42 (see FIG. 11) of the push-up member 4 enters, and a second groove 5*b* into which the second protrusion 32 (see FIG. 9) of the support member 3 enters. The first groove 5*a* is provided in the front insertion portion 51. The first groove 5*a* penetrates the front insertion portion 51. The first groove 5*a* includes a first inclination groove 5*c* extending in a first inclination direction D3 which is a direction inclined with respect to the axial direction D1, and a second inclination groove 5*d* extending in a second inclination direction D4 which is a direction inclined with respect to both the axial direction D1 and the first inclination direction D3 from an end portion of the first inclination groove 5*c*. In the embodiment, the second inclination groove 5*d* extends along the circumferential direction D2. That is, the second inclination direction D4 is the same direction as the circumferential direction D2. One end of the second inclination groove 5*d* is connected to a front end of the first inclination groove 5*c*. The screw tube 5 includes, for example, a pair of first grooves 5*a*. The pair of first grooves 5*a* are disposed at positions sandwiching an axis of the screw tube 5. One of the pair of first grooves 5*a* overlaps the other of the pair of first grooves 5*a* when the screw tube 5 rotates by 180° around the axis.

The second groove 5*b* is provided in an inner peripheral surface of the screw tube 5. The second groove 5*b* has, for example, a spiral shape extending around the axis of the screw tube 5. In this case, the second groove 5*b* is a spiral groove. For example, the second groove 5*b* does not penetrate the screw tube 5. The screw tube 5 includes a pair of second grooves 5*b*. The pair of second grooves 5*b* are disposed at positions sandwiching the axis of the screw tube 5. One of the pair of second grooves 5*b* overlaps the other of the pair of second grooves 5*b* when the screw tube 5 rotates by 180° around the axis. The second groove 5*b* includes a third inclination groove 5*e* extending in a third inclination direction D5 which is a direction inclined with respect to the axial direction D1, the first inclination direction D3, and the second inclination direction D4. An angle of the third inclination direction D5 with respect to the axial direction D1 is larger than an angle of the first inclination direction D3 with respect to the axial direction D1 and is smaller than an angle of the second inclination direction D4 with respect to the axial direction D1.

An inclination angle of the first inclination direction D3 with respect to the axial direction D1 is, for example, 20° or more and 30° or less. In the embodiment, the inclination angle of the first inclination direction D3 with respect to the axial direction D1 is, for example, 25°. An inclination angle of the second inclination direction D4 with respect to the axial direction D1 is, for example, 70° or more and 90° or less. In the embodiment, the inclination angle of the second inclination direction D4 with respect to the axial direction D1 is, for example, 90°. An inclination angle of the third inclination direction D5 with respect to the axial direction D1 is, for example, 30° or more and 45° or less. In the embodiment, the inclination angle of the third inclination direction D5 with respect to the axial direction D1 is, for example, 37.8°.

Next, a positional relationship among the container 2 (the operation portion 21 and the accommodating tube 22), the support member 3, the push-up member 4, and the screw tube 5 inside the feeding container 1 will be described. As shown in FIG. 4, the rear insertion portion 52, the flange portion 58, and the diameter enlarged portion 59 of the screw tube 5 are disposed between the accommodating tube 22 and the operation portion 21 along a radial direction of the container 2. The screw tube 5 is positioned radially outward of the accommodating tube 22. The container 2 (corresponding to each of the operation portion 21 and the accommodating tube 22) is relatively rotatable with respect to the screw tube 5.

As shown in FIGS. 7, 9, and 11, the first guide hole 221*b* and the second guide hole 221*c* extend along the axial direction D1 in the accommodating tube 22. Accordingly, the first protrusion 42 of the push-up member 4 that has entered the first guide hole 221*b* and the second protrusion 32 of the support member 3 that has entered the second guide hole 221*c* are not restricted from moving in the axial direction D1 with respect to the container 2 (the accommodating tube 22). Accordingly, the support member 3 and the push-up member 4 are movable in the axial direction D1 with respect to the container 2 (the accommodating tube 22).

As shown in FIGS. 9, 11, and 12, the first protrusion 42 inserted through the first guide hole 221*b* of the container 2 (accommodating tube 22) enters the first groove 5*a* of the screw tube 5 extending along the first inclination direction D3. The push-up member 4 synchronously rotates with the container 2 (each of the operation portion 21 and the accommodating tube 22). When the operation portion 21 and the screw tube 5 relatively rotate with respect to each other, the push-up member 4 relatively rotates with respect to the screw tube 5 together with the container 2. When the push-up member 4 relatively rotates with respect to the screw tube 5, the first protrusion 42 moves along the first groove 5*a*. Since the first inclination direction D3 is inclined with respect to the axial direction D1, when the push-up member 4 relatively rotates with respect to the screw tube 5 in a state where the first protrusion 42 enters the first inclination groove 5*c*, the push-up member 4 moves in the axial direction D1 with respect to the screw tube 5. In the embodiment, since the second inclination direction D4 is the same direction as the circumferential direction D2, in a state where the first protrusion 42 enters the second inclination groove 5*d*, the push-up member 4 does not move in the axial direction D1 with respect to the screw tube 5 even when the push-up member 4 relatively rotates with respect to the screw tube 5.

The second protrusion 32 of the support member 3 inserted through the second guide hole 221*c* of the container 2 (accommodating tube 22) enters the second groove 5*b* of the screw tube 5 extending along the third inclination direction D5. The support member 3 synchronously rotates with the container 2. When the operation portion 21 and the screw tube 5 relatively rotate with respect to each other, the support member 3 relatively rotates with respect to the screw tube 5 together with the container 2. When the support member 3 relatively rotates with respect to the screw tube 5, the second protrusion 32 moves along the second groove 5*b*. Since the third inclination direction D5 is inclined with respect to the axial direction D1, in a state where the second protrusion 32 enters the third inclination groove 5*e*, when the support member 3 relatively rotates with respect to the screw tube 5, the support member 3 moves in the axial direction D1 with respect to the screw tube 5.

As described above, the inclination angle of the first inclination direction D3 with respect to the axial direction D1 is smaller than the inclination angle of the third inclination direction D5 with respect to the axial direction D1. Accordingly, when the first protrusion 42 enters the first groove 5*a*, the second protrusion 32 enters the second groove 5*b*, and the screw tube 5, the push-up member 4, and the support member 3 are rotated, a movement amount of the push-up member 4 in the axial direction D1 with respect to the screw tube 5 is larger than a movement amount of the support member 3 in the axial direction D1 with respect to the screw tube 5.

Figure 14:
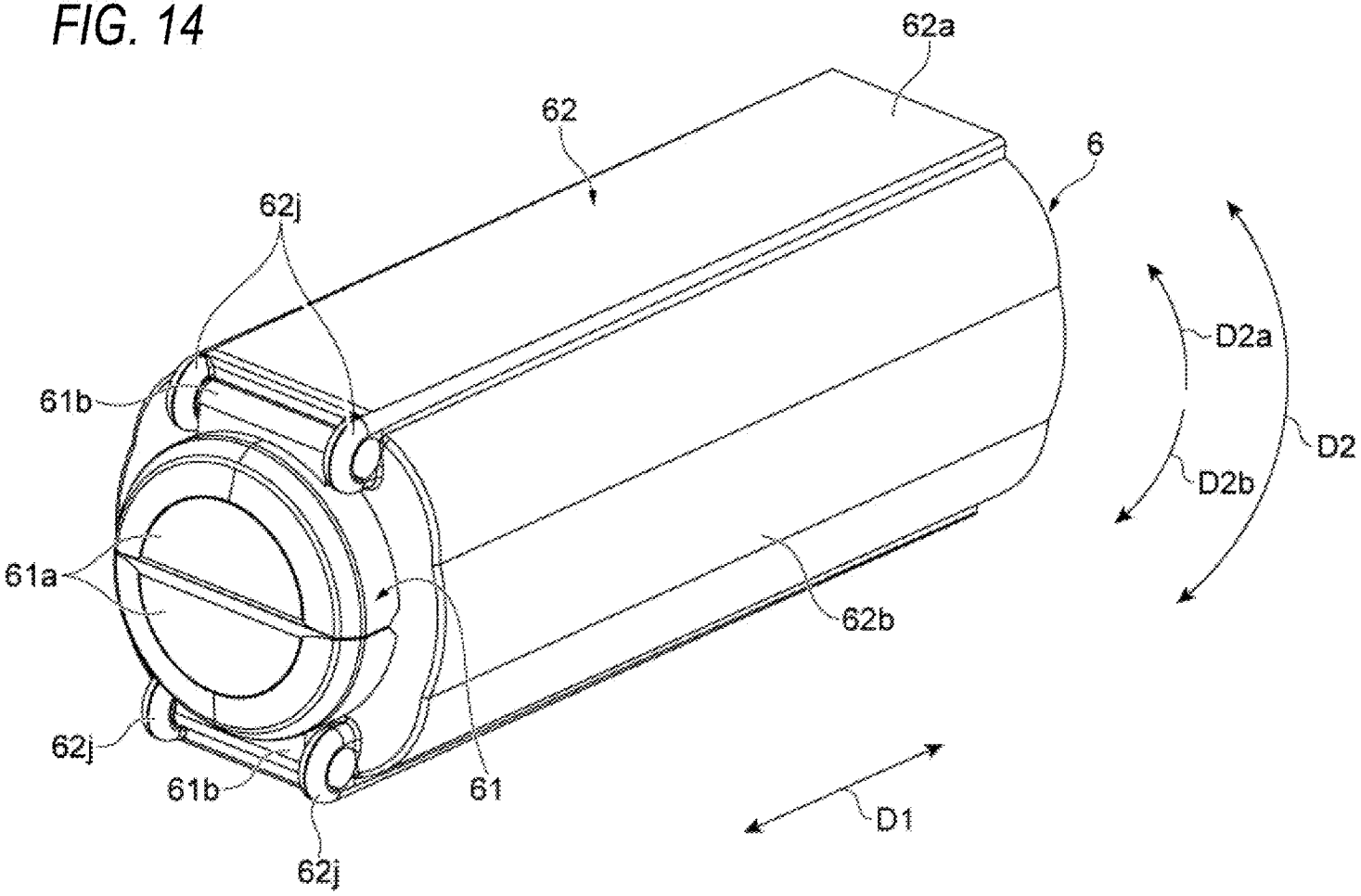
FIG. 14 is a perspective view of an inner cap.
Figure 15:
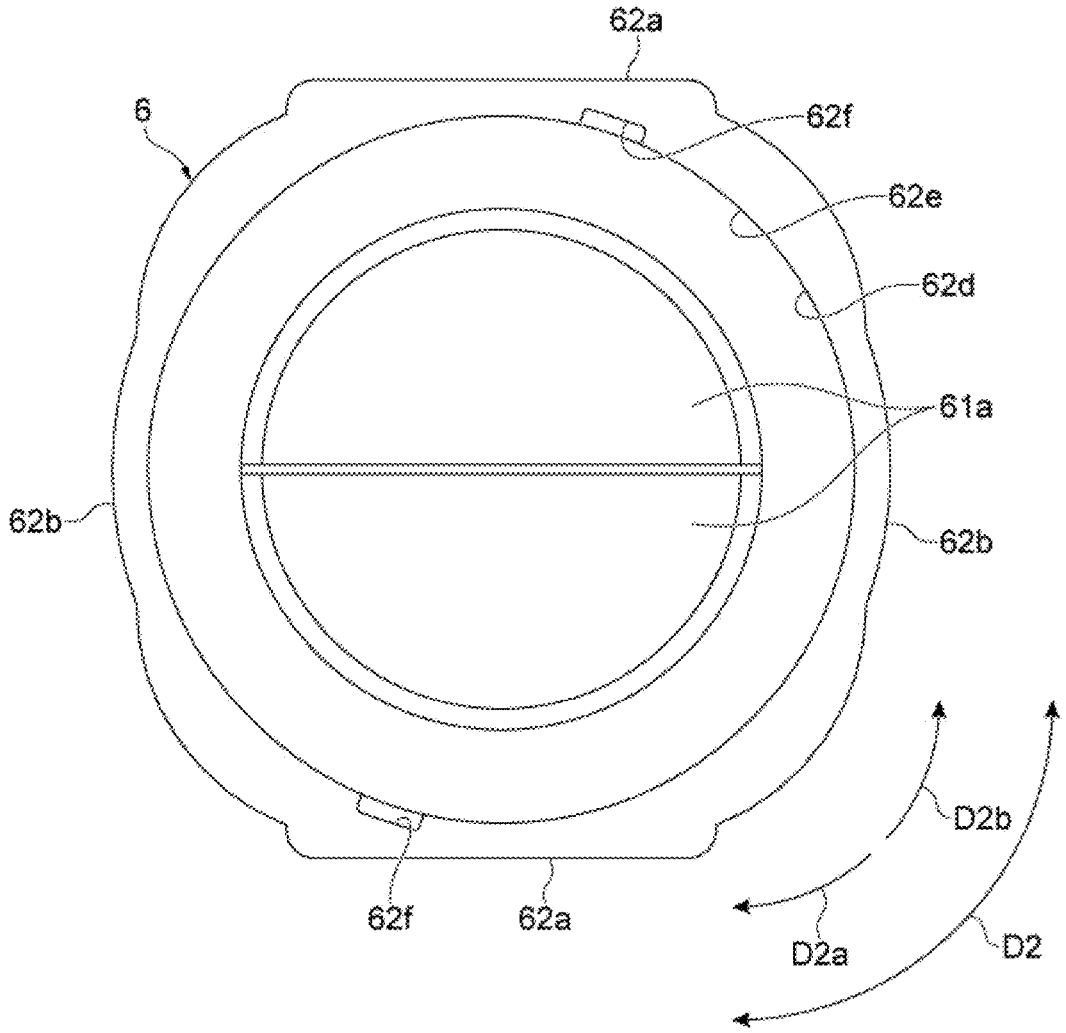
FIG. 15 is a rear view of the inner cap.

FIG. 14 is a perspective view of the inner cap 6. FIG. 15 is a rear view of the inner cap 6. As shown in FIGS. 4, 14, and 15, the inner cap 6 surrounds the screw tube 5. The inner cap 6 includes the lid portion 61 that opens and closes the first opening 221*a* of the container 2 (accommodating tube 22), and a main body portion 62 positioned behind the lid portion 61. The main body portion 62 has, for example, a tubular shape. The main body portion 62 includes a pair of flange portions 62*a* and a pair of side surface portions 62*b*. The pair of flange portions 62*a* are disposed at positions sandwiching an axis of the inner cap 6. The flange portion 62*a* has a smooth surface facing to the outer side in the radial direction. The smooth surface has, for example, a rectangular shape. The pair of side surface portions 62*b* are disposed at positions sandwiching the axis of the inner cap 6. Each of the pair of side surface portions 62*b* is sandwiched between the pair of flange portions 62*a* in the circumferential direction D2.

For example, an outer surface of the side surface portion 62*b* includes three curved surfaces. The three curved surfaces are arranged along the circumferential direction D2 when viewed from the axial direction D1. As viewed from the axial direction D1, a curvature of each of the upper curved surface and the lower curved surface among the three curved surfaces is larger than a curvature of a circle whose center is the axis of the inner cap 6 and whose radius is a line segment from the axis of the inner cap 6 to the side surface portion 62*b*. A curvature of the curved surface between the upper curved surface and the lower curved surface is smaller than the curvature of the circle.

The main body portion 62 has a front opening 62*c* provided at a front end of the main body portion 62 and a rear opening 62*d* provided at a rear end of the main body portion 62. For example, an inner diameter of the front opening 62*c* is smaller than an inner diameter of the rear opening 62*d*. The inner diameter of the front opening 62*c* is larger than an outer diameter of the push-up member 4. A front portion of the screw tube 5 is inserted into the main body portion 62 from the rear opening 62*d*. When the screw tube 5 is inserted into the main body portion 62 from the rear opening 62*d*, the front insertion portion 51 of the screw tube 5 is disposed inside the inner cap 6.

The main body portion 62 has an inner peripheral surface 62*e* extending forward from the rear opening 62*d* and grooves 62*f* provided in the inner peripheral surface 62*e*. The groove 62*f* corresponds to a portion recessed in the inner peripheral surface 62*e*. The groove 62*f* extends in the axial direction D1. For example, the main body portion 62 has a plurality of (for example, two) grooves 62*f*. For example, a pair of grooves 62*f* are arranged along the radial direction of the main body portion 62. The protruding portion 55 (see FIG. 12) provided on the outer peripheral surface of the screw tube 5 enters the groove 62*f*. When the screw tube 5 is inserted into the inner cap 6, the protruding portion 55 enters the groove 62*f*. Accordingly, the screw tube 5 is synchronously rotatably engaged with the inner cap 6.

The main body portion 62 includes a fitting portion 62*k* to which the screw tube 5 is fitted on the inner peripheral surface 62*e*. The fitting portion 62*k* is, for example, a fitting recessed portion extending in the circumferential direction D2. The annular protruding portion 54 of the screw tube 5 enters the fitting portion 62*k*. Accordingly, the screw tube 5 is fitted to the inner cap 6 so as to be immovable in the axial direction.

The lid portion 61 opens and closes the first opening 221*a* while being connected to the container 2. The lid portion 61 includes lid portion bodies 61*a* closing the front opening 62*c* and hinge portions 61*b* connected to the lid portion body 61*a*. The lid portion body 61*a* has, for example, a semicircular shape. For example, the lid portion 61 includes a pair of lid portion bodies 61*a*. For example, the pair of lid portion bodies 61*a* having a semicircular shape are arranged along the radial direction of the main body portion 62. Accordingly, the lid portion 61 has a circular shape when viewed from the axial direction D1.

As described above, in the lid portion 61, the pair of lid portion bodies 61*a* are arranged to form a circular shape. When the pair of lid portion bodies 61*a* pivot via the respective hinge portions 61*b*, the front opening 62*c* opens and closes. The hinge portion 61*b* extends in a width direction of the main body portion 62. The hinge portion 61*b* may extend in a width direction of the flange portion 62*a*. The hinge portion 61*b* has, for example, a columnar shape. For example, the main body portion 62 includes a pair of hinge fixing portions 62*j* to which both ends of the hinge portion 61*b* are connected.

The hinge fixing portions 62*j* are provided at a front end of the flange portion 62*a*. The hinge fixing portions 62*j* are provided at an end portion of the flange portion 62*a* in the width direction. The hinge portion 61*b* is connected to the hinge fixing portions 62*j* in a pivotable state with respect to the hinge fixing portions 62*j*. The hinge portions 61*b* are provided in front of the container 2 (accommodating tube 22). The lid portion 61 is pivotable via the hinge portion 61*b* provided on the container 2. For example, the hinge portion 61*b* is provided in front of the container 2. The lid portion 61 opens and closes the first opening 221*a* of the container 2 (the accommodating tube 22) by pivoting via the hinge portion 61*b*.

Figure 16:
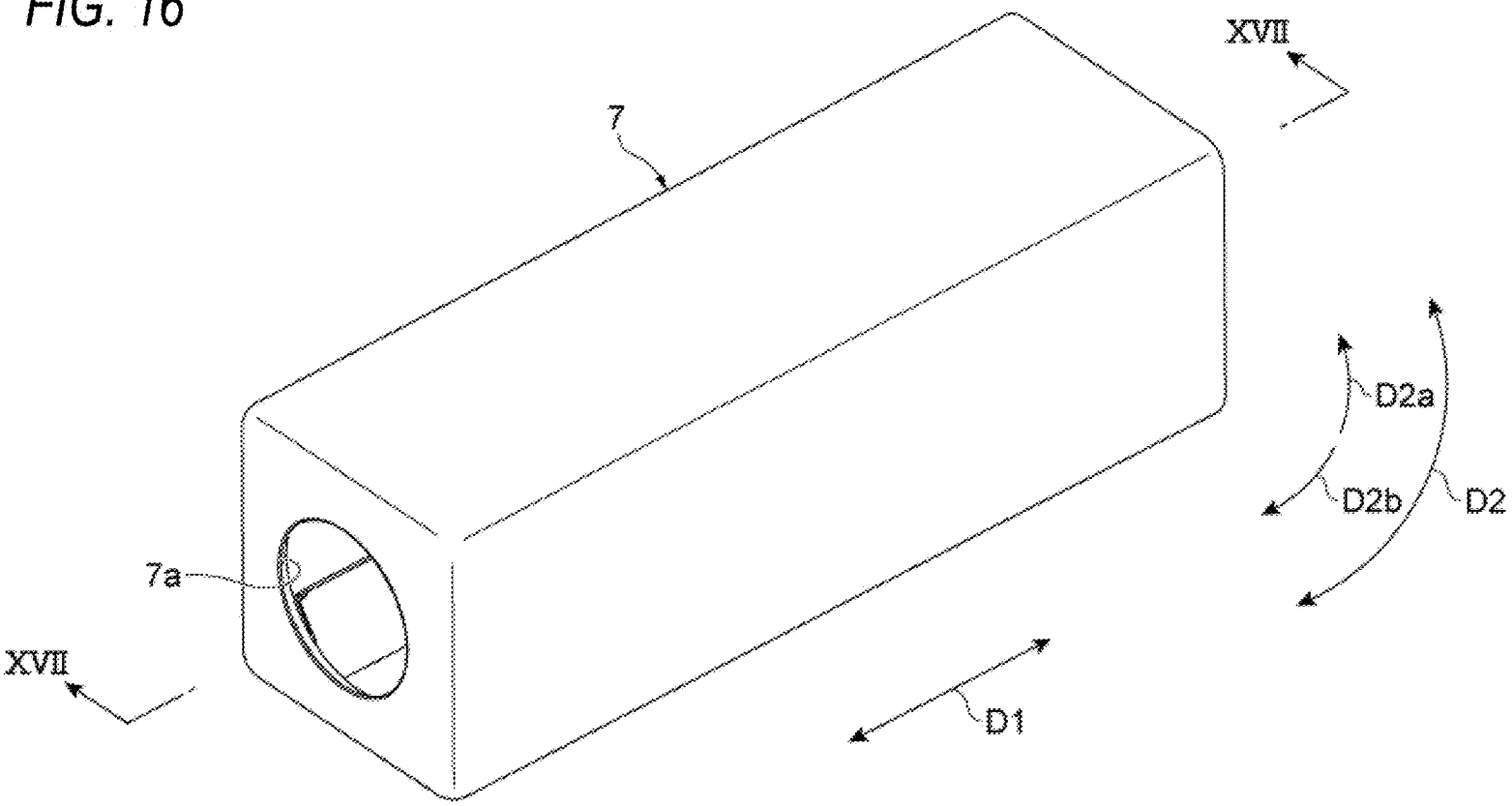
FIG. 16 is a perspective view of the lock member.
Figure 17:
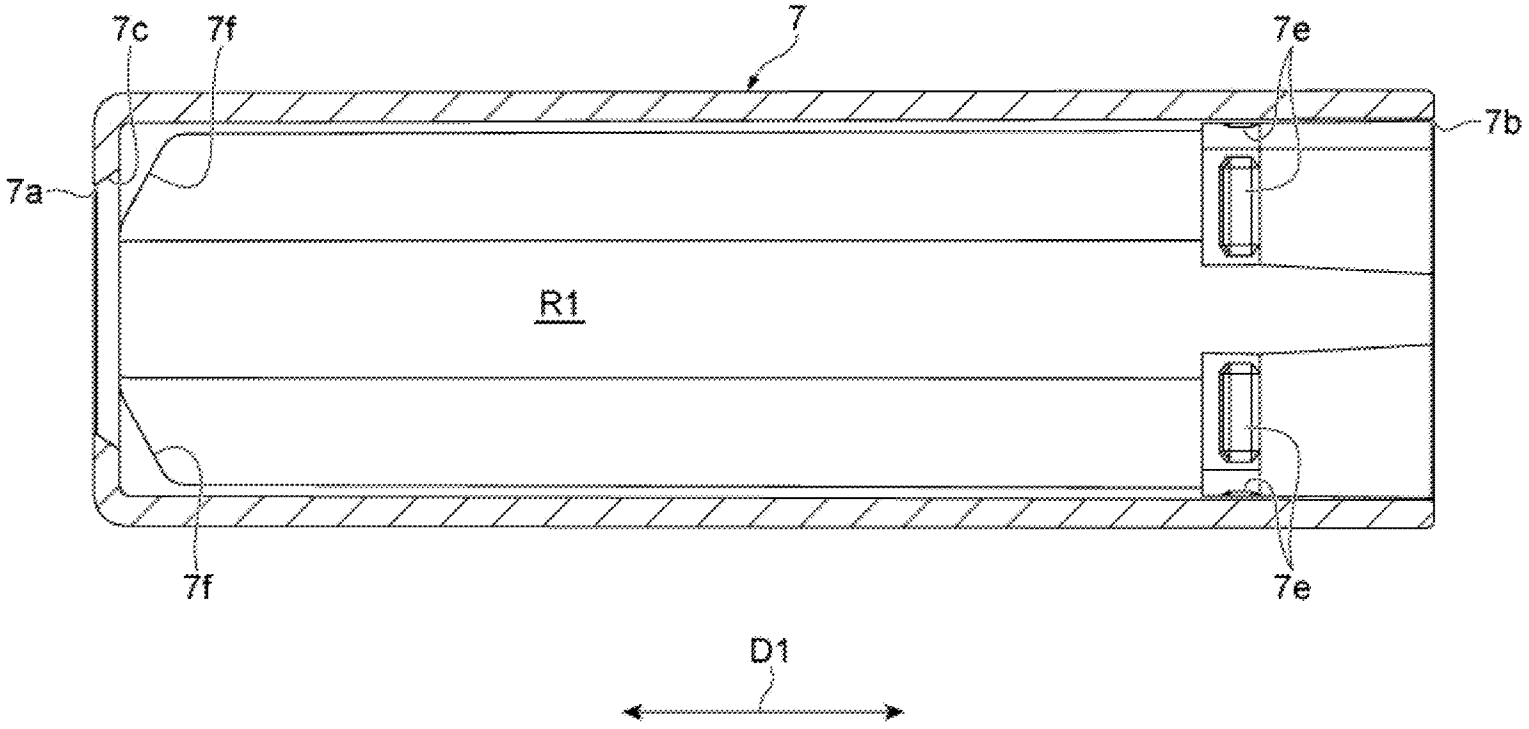
FIG. 17 is a cross-sectional view taken along a line XVII-XVII in FIG. 16.

FIG. 16 is a perspective view of the lock member 7. FIG. 17 is a cross-sectional view taken along a line XVII-XVII in FIG. 16. As shown in FIGS. 4, 16, and 17, the lock member 7 has a tubular shape. For example, the inner cap 6 is inserted into the lock member 7. The lock member 7 covers the lid portion 61. For example, the lock member 7 has a rectangular shape when viewed from the axial direction D1. More specifically, a shape of the lock member 7 viewed from the axial direction D1 is a corner-rounded rectangular shape. For example, the shape of the lock member 7 is a corner-rounded square shape. For example, the lock member 7 accommodates the screw tube 5 and is engaged with the screw tube 5 in the circumferential direction D2. The lock member 7 is rotatable synchronously with the screw tube 5.

Figure 18:
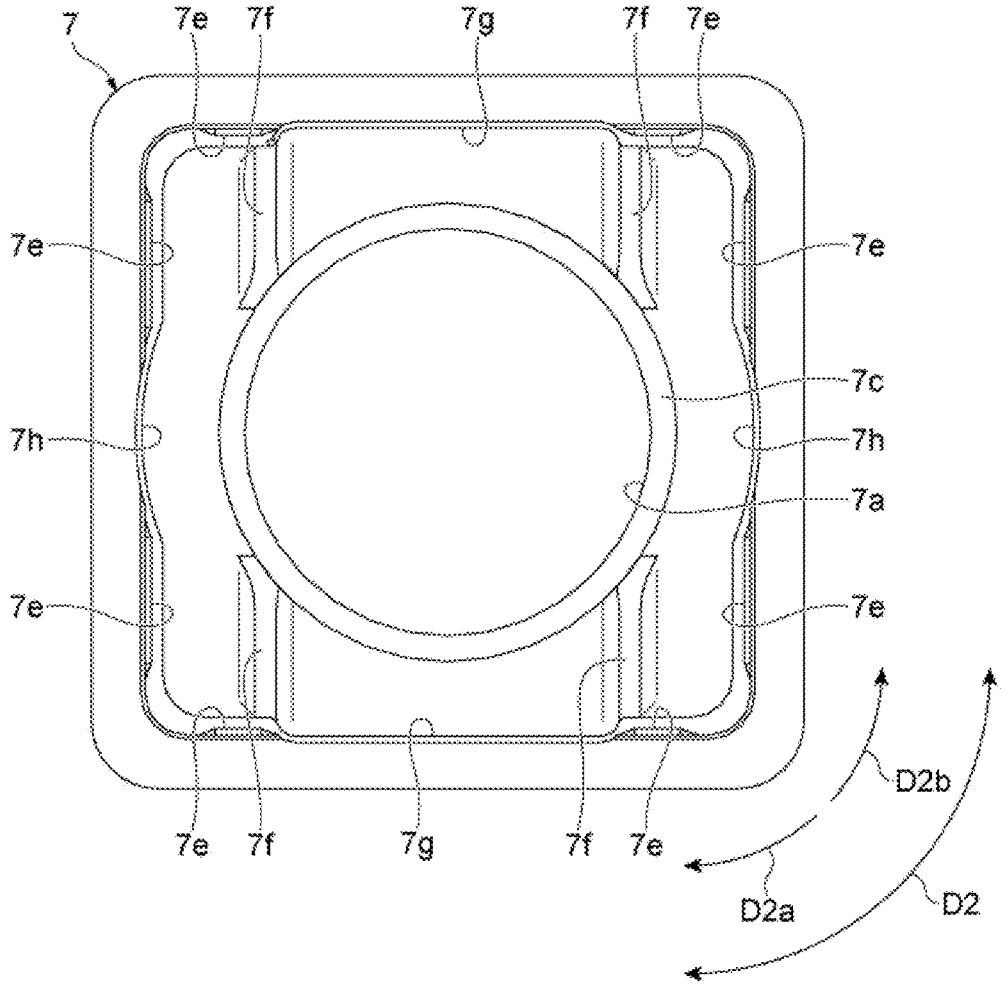
FIG. 18 is a rear view of the lock member.

FIG. 18 is a rear view of the lock member 7. As shown in FIGS. 4, 17, and 18, an inner cap accommodating region R1 extending rearward from the front end of the lock member 7 is provided inside the lock member 7. The inner cap 6 is accommodated in the inner cap accommodating region R1. For example, when viewed from the axial direction D1, an inner peripheral surface of the lock member 7 and an outer peripheral surface of the inner cap 6 have the same shape. The lock member 7 has a pair of flat surfaces 7*g* respectively facing the flange portions 62*a* (see FIG. 15) of the inner cap 6, and a pair of inner peripheral side surfaces 7*h* respectively facing the side surface portions 62*b* of the inner cap 6. The inner cap 6 is accommodated inside the lock member 7 through a rear opening 7*b* positioned at a rear end of the lock member 7.

As described above, inside the lock member 7, the flange portions 62*a* of the inner cap 6 face the flat surfaces 7*g*, and the side surface portions 62*b* of the inner cap 6 face the inner peripheral side surfaces 7*h*. At this time, the inner cap 6 and the lock member 7 synchronously rotate in the circumferential direction D2. The lock member 7 is movable in the axial direction D1 with respect to the inner cap 6.

In the locked state where the lid portion 61 is restricted from being opened, a front end of the hinge fixing portion 62*j* is in contact with the inner surface of the front end of the lock member 7. The lock member 7 includes a lock portion 7*c* that restricts the opening of the lid portion 61. The lock portion 7*c* is positioned, for example, at the front end of the lock member 7. The lock portion 7*c* extends in the circumferential direction D2 so as to surround the second opening 7*a*. The lock portion 7*c* defines the second opening 7*a*.

The lock portion 7*c* is in contact with the lid portion 61 to lock the lid portion 61. In the embodiment, locking refers to a state where the lock portion 7*c* is in contact with the lid portion 61 to restrict the opening of the lid portion 61. When the lock member 7 moves forward with respect to the lid portion 61, the lock portion 7*c* is separated from the lid portion 61. When the lock portion 7*c* is separated from the lid portion 61, the locking of the lid portion 61 due to the lock member 7 is released. When the locking of the lid portion 61 due to the lock member 7 is released, the lid portion 61 is in an openable state, so that the cosmetic M can be exposed from the first opening 221*a* of the container 2.

The lock member 7 includes guide portions 7*f* for guiding the lid portion 61. The guide portion 7*f* protrudes radially inward of the lock member 7 from a peripheral wall of the lock member 7. As shown in FIG. 17, for example, the guide portion 7*f* has a shape having an inclined portion inclined with respect to the axial direction D1. For example, the guide portion 7*f* has a right triangle shape. The guide portion 7*f* extends in a direction intersecting the flat surface 7*g*. The guide portion 7*f* may extend in a direction orthogonal to the flat surface 7*g*. The guide portion 7*f* is connected to the flat surface 7*g*. The guide portion 7*f* having a right triangle shape has an oblique side and a pair of adjacent sides extending from both ends of the oblique side. One of the pair of adjacent sides is connected to the flat surface 7*g*. The guide portion 7*f* extends, for example, from the inner peripheral surface of the lock member 7 to the second opening 7*a*. A length of the guide portion 7*f* in the axial direction D1 increases toward the inner peripheral surface of the lock member 7.

The lock member 7 includes, for example, a plurality of guide portions 7*f*. For example, the two guide portions 7*f* are disposed at positions sandwiching the flat surface 7*g*. The two guide portions 7*f* are arranged along a direction in which the pair of flat surfaces 7*g* face each other. For example, the lock member 7 includes four guide portions 7*f*. In this case, the four guide portions 7*f* may be disposed to form a long rectangular shape when viewed from the axial direction D1.

The lock member 7 includes protruding portions 7*e* connected to rear ends of the inner cap accommodating region R1.

The protruding portion 7*e* is a portion where the restriction portion 8 (see FIG. 2) into which the above-described screw tube 5 is inserted is engaged. The lock member 7 includes, for example, a plurality of protruding portions 7*e*. In the embodiment, the lock member 7 includes eight protruding portions 7*e*. For example, when viewed from the axial direction D1, the eight protruding portions 7*e* are provided such that every two protruding portions 7*e* sandwich a corner portion of the lock member 7. The protruding portion 7*e* protrudes from the inner peripheral surface of the lock member 7 toward an axis of the lock member 7. The protruding portion 7*e* extends in the circumferential direction D2.

In the embodiment, a profile of a cross section intersecting the axial direction D1 in a rear side of the neck portion 212 of the operation portion 21 has a non-circular shape. For example, this profile has a rectangular shape. Accordingly, when the lock member 7 is close to the operation portion 21, even if the lock member 7 is to rotate with respect to the operation portion 21, an inner surface of the lock member 7 is in contact with a non-circular portion of the neck portion 212, so that the lock member 7 cannot relatively rotate with respect to the operation portion 21. On the other hand, a profile of a cross section intersecting the axial direction D1 in a front side of the neck portion 212 has a circular shape. Accordingly, when the lock member 7 is separated forward from the operation portion 21, since the inner surface of the lock member 7 is not in contact with the operation portion 21 when the lock member 7 is to rotate with respect to the operation portion 21, the lock member 7 can relatively rotate with respect to the operation portion 21.

Figure 19:
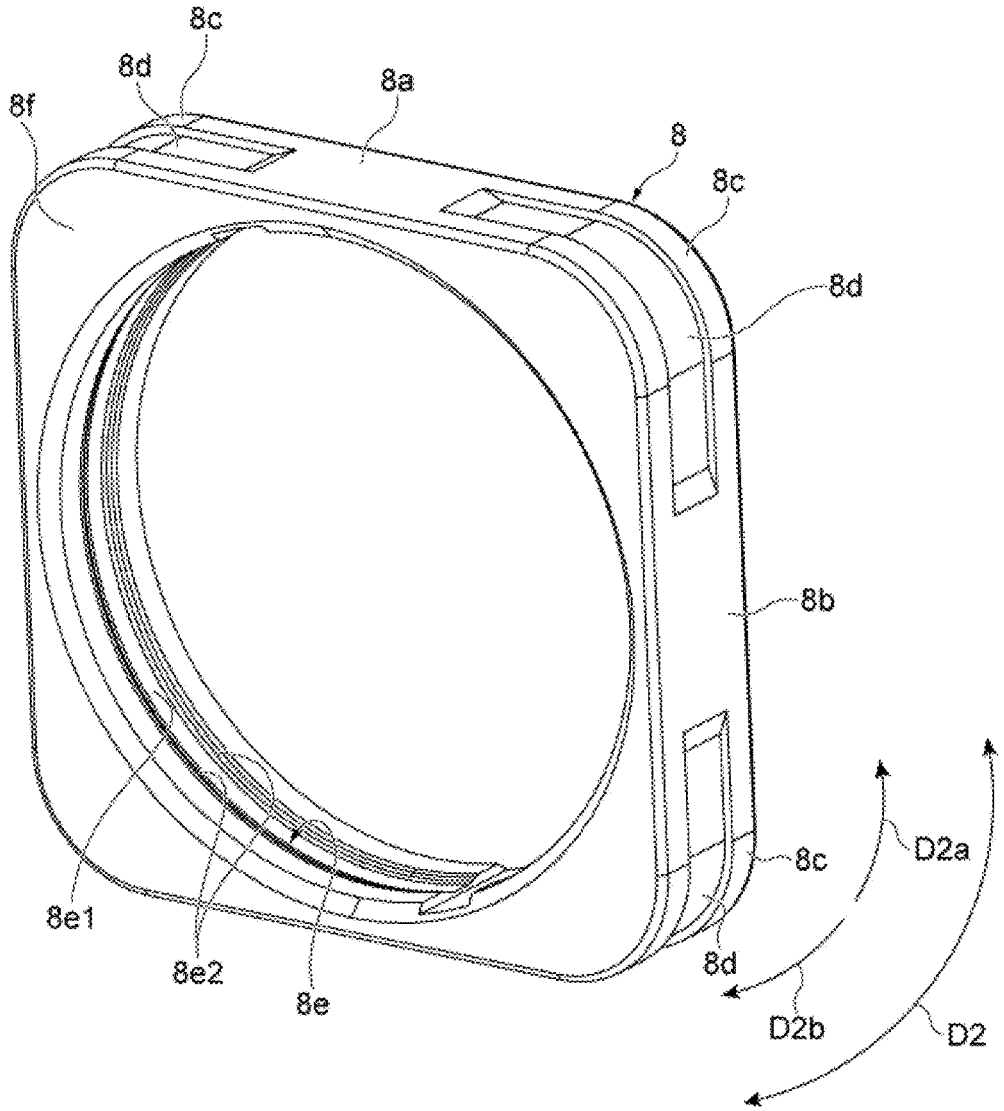
FIG. 19 is a perspective view of a restriction portion.

FIG. 19 is a perspective view of the restriction portion 8. As shown in FIGS. 4 and 19, the restriction portion 8 is interposed between the screw tube 5 and the lock member 7. The restriction portion 8 restricts a movement amount of the lock member 7 in the axial direction D1 with respect to the container 2 such that the lock member 7 does not move by a certain amount or more with respect to the container 2. For example, the restriction portion 8 faces the front end of the operation portion 21 along the axial direction D1.

For example, the restriction portion 8 has an annular shape. The restriction portion 8 includes a pair of flat portions 8*a* facing each other, and a pair of flat portions 8*b* facing each other in a direction different from a direction in which the pair of flat portions 8*a* face each other. The pair of flat portions 8*a* are disposed at positions sandwiching an axis of the restriction portion 8. The pair of flat portions 8*b* are disposed at positions sandwiching the axis of the restriction portion 8. For example, the pair of flat portions 8*a* and the pair of flat portions 8*b* are disposed at equal intervals along the circumferential direction D2. For example, in the pair of flat portions 8*a* and the pair of flat portions 8*b*, all of the four flat portions may have the same shape and size.

The restriction portion 8 includes a plurality of corner portions 8*c*. In the embodiment, the restriction portion 8 includes four corner portions 8*c*. Each corner portion 8*c* is disposed between the flat portion 8*a* and the flat portion 8*b*. The restriction portion 8 includes outer grooves 8*d* provided in the corner portions 8*c*. The outer groove 8*d* extends along the circumferential direction D2. The outer groove 8*d* extends from the flat portion 8*a* to the flat portion 8*b*. The outer groove 8*d* has a shape in which the protruding portion 7*e* (see FIG. 17) formed on the inner surface of the lock member 7 enters. When the protruding portion 7*e* enters the outer groove 8*d*, the restriction portion 8 engages with the lock member 7 in the axial direction D1.

That is, since the protruding portion 7*e* enters the outer groove 8*d*, when the lock member 7 moves along the axial direction D1, the restriction portion 8 moves together with the lock member 7 along the axial direction D1. When the lock member 7 rotates along the circumferential direction D2, the protruding portion 7*e* comes into contact with the flat portion 8*a* (or the flat portion 8*b*), so that the restriction portion 8 rotates together with the lock member 7 in the circumferential direction D2. Accordingly, the restriction portion 8 is rotatable synchronously with the lock member 7.

The restriction portion 8 includes an inner groove 8*e* provided in an inner peripheral surface of the restriction portion 8. The inner groove 8*e* extends, for example, along the circumferential direction D2 in the inner peripheral surface of the restriction portion 8. The protruding portion 56 or the protruding portion 57 (see FIG. 12) of the screw tube 5 enters the inner groove 8*e*. The inner groove 8*e* has a bottom surface 8*e*1 and inclination surfaces 8*e*2. The bottom surface 8*e*1 has a surface parallel to the outer peripheral surface of the rear insertion portion 52. A depth of the inner groove 8*e* is constant at the bottom surface 8*e*1. The inner groove 8*e* has a pair of inclination surfaces 8*e*2. The pair of inclination surfaces 8*e*2 are disposed at positions sandwiching the bottom surface 8*e*1 along the axial direction D1. The inclination surfaces 8*e*2 extends toward the axis of the restriction portion 8 as extending away from the bottom surface 8*e*1 in the axial direction D1. That is, the depth of the inner groove 8*e* in the inclination surface 8*e*2 is shallower as the inner groove 8*e* is separated from the bottom surface 8*e*1 along the axial direction D1.

The protruding portion 56 or the protruding portion 57 that has entered the inner groove 8*e* moves with respect to the inner groove 8*e* along the axial direction D1. When the protruding portion 56 or the protruding portion 57 moves with respect to the inner groove 8*e*, the protruding portion 56 or the protruding portion 57 moves on the inclination surface 8*e*2, so that the protruding portion 56 or the protruding portion 57 can be easily detached from the inner groove 8*e*. Accordingly, the restriction portion 8 can be moved in the axial direction D1 with respect to the screw tube 5.

However, the protruding portion 56 or the protruding portion 57 that has entered the inner groove 8*e* is not detached from the inner groove 8*e* unless an external force along the axial direction D1 is applied to the lock member 7. For example, in the feeding container 1 in the unlocked state, even when a weak external force along the axial direction D1 is applied to the lock member 7, the lock member 7 does not approach the operation portion 21. For example, when the user brings the lock member 7 close to the operation portion 21 with the fingers, the protruding portion 57 is detached from the inner groove 8*e* and the feeding container 1 is switched from the unlocked state to the locked state by the external force being applied to the feeding container 1. For example, when the user moves the lock member 7 forward with the fingers, the protruding portion 56 is detached from the inner groove 8*e* and the feeding container 1 is switched from the locked state to the unlocked state by the external force being applied to the feeding container 1.

The restriction portion 8 has a front end surface 8*f* that intersects the axial direction D1. The front end surface 8*f* may be orthogonal to the axial direction D1. When the restriction portion 8 moves forward together with the lock member 7 with respect to the screw tube 5, the front end surface 8*f* comes into contact with a rear end of the inner cap 6. When the front end surface 8*f* comes into contact with the rear end of the inner cap 6, the lock member 7 and the restriction portion 8 cannot further move forward with respect to the screw tube 5. Accordingly, a region in which the lock member 7 and the restriction portion 8 can move along the axial direction D1 is limited to a range in which the restriction portion 8 is positioned between the front end of the operation portion 21 and the rear end of the inner cap 6.

Figure 20A:
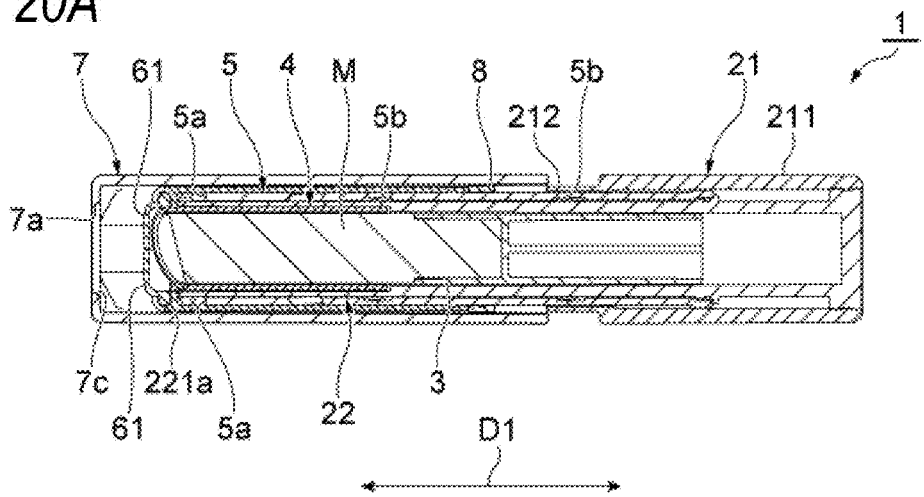
FIG. 20A is a cross-sectional view of the feeding container in the accommodating state and in an unlocked state.
Figure 20B:
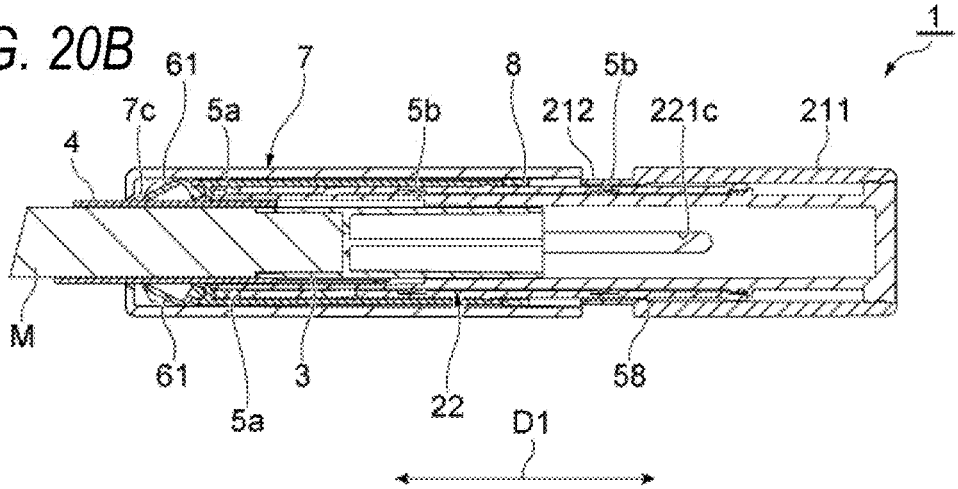
FIG. 20B is a cross-sectional view of the feeding container in the use state.
Figure 20C:
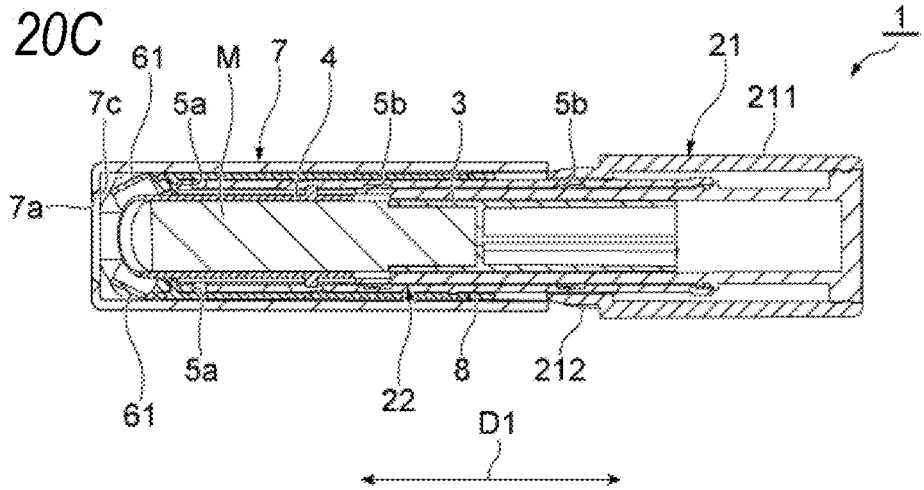
FIG. 20C is a cross-sectional view showing an operation when the feeding container shifts from the use state to the accommodating state.

Next, an operation of the feeding container 1 will be described in detail with reference to FIG. 20A, FIG. 20B, and FIG. 20C. FIG. 20A is a cross-sectional view of the feeding container 1 in the accommodating state and in the unlocked state. FIG. 20B is a cross-sectional view of the feeding container 1 in the use state. FIG. 20C is a cross-sectional view showing an operation when the feeding container 1 shifts from the use state to the accommodating state. As shown in FIG. 4 and FIG. 20A, in the feeding container 1 in the accommodating state and in the locked state, when the lock member 7 is moved along the axial direction D1 (for example, forward) with respect to the operation portion 21, the lock portion 7*c* is separated from the lid portion 61. When the lock portion 7*c* is separated from the lid portion 61, the lid portion 61 is in an openable and closable state, so that the feeding container 1 is in the unlocked state. At this time, since the lock member 7 is separated forward from the operation portion 21, the lock member 7 can relatively rotate with respect to the container 2.

In the feeding container 1 in the accommodating state and in the unlocked state, when the operation portion 21 is relatively rotated in the one direction D2*a* with respect to the lock member 7, the operation portion 21 relatively rotates with respect to the lock member 7 and the screw tube 5.

Since the support member 3, the push-up member 4, and the accommodating tube 22 synchronously rotate, when the operation portion 21 relatively rotates in the one direction D2*a* with respect to the screw tube 5, the screw tube 5 relatively rotates with respect to the support member 3 and the push-up member 4. When the operation portion 21 relatively rotates in the one direction D2*a* with respect to the screw tube 5, the first protrusion 42 of the push-up member 4 moves forward along the first groove 5*a*. The first protrusion 42 moves from the first inclination groove 5*c* toward the second inclination groove 5*d* before or at the same time as the push-up member 4 pushes up the lid portion 61. In the feeding container 1 in the accommodating state, the first protrusion 42 moves forward along the first inclination groove 5*c*, and the second protrusion 32 of the support member 3 moves forward along the third inclination groove 5*e*. Since the angle of the first inclination direction D3, which is a direction in which the first inclination groove 5*c* extends, with respect to the axial direction D1 is smaller than the angle of the third inclination direction D5, which is a direction in which the third inclination groove 5*e* extends, with respect to the axial direction D1, the push-up member 4 moves in the axial direction D1 (moves forward) with respect to the support member 3. That is, when the first protrusion 42 is in the first inclination groove 5*c*, a movement speed of the push-up member 4 in the axial direction D1 is higher than a movement speed of the support member 3 in the axial direction D1. When the push-up member 4 moves forward with respect to the support member 3, the push-up member 4 pushes up the lid portion 61 to open the first opening 221*a*.

When the operation portion 21 is further relatively rotated with respect to the lock member 7, as shown in FIG. 20B, the push-up member 4 is fed out from the second opening 7*a* of the lock member 7. The first protrusion 42 of the push-up member 4 moves from the first inclination groove 5*c* toward the second inclination groove 5*d* before or at the same time as the push-up member 4 pushes up the lid portion 61. That is, when the push-up member 4 pushes up the lid portion 61 (reaches the lid portion 61), the first protrusion 42 is positioned in the first inclination groove 5*c* and starts moving from the first inclination groove 5*c* to the second inclination groove 5*d*.

After the first protrusion 42 moves from the first inclination groove 5*c* to the second inclination groove 5*d*, when the operation portion 21 is relatively rotated with respect to the lock member 7, the first protrusion 42 moves along the second inclination groove 5*d*, and the second protrusion 32 of the support member 3 moves along the third inclination groove 5*e*. Since the angle of the second inclination direction D4, which is a direction in which the second inclination groove 5*d* extends, with respect to the axial direction D1 is larger than the angle of the third inclination direction D5, which is a direction in which the third inclination groove 5*e* extends, with respect to the axial direction D1, the support member 3 moves in the axial direction D1 (moves forward) with respect to the push-up member 4. That is, when the first protrusion 42 is in the second inclination groove 5*d*, the movement speed of the support member 3 in the axial direction D1 is higher than the movement speed of the push-up member 4 in the axial direction D1. When the support member 3 moves forward with respect to the push-up member 4, the cosmetic M is fed out from an opening formed at a front end of the push-up member 4.

As described above, when the screw tube 5 and the operation portion 21 relatively rotate with respect to each other in the one direction D2*a*, the first protrusion 42 of the push-up member 4 moves along the first groove 5*a* of the screw tube 5, and the push-up member 4 pushes up the lid portion 61 to open the first opening 221*a*. Then, the second protrusion 32 of the support member 3 moves along the second groove 5*b* of the screw tube 5, and the support member 3 moves forward, so that the cosmetic M is fed out from the first opening 221*a*. Accordingly, the feeding container 1 is in the use state from the accommodating state.

When the screw tube 5 and the operation portion 21 relatively rotate with respect to each other in the opposite direction D2*b*, as shown in FIG. 20C, the second protrusion 32 of the support member 3 moves rearward along the second groove 5*b* of the screw tube 5, the support member 3 moves in the axial direction D1, and the cosmetic M is housed in the first opening 221*a*. The first protrusion 42 of the push-up member 4 moves from the second inclination groove 5*d* of the screw tube 5 toward the first inclination groove 5*c*, and the second protrusion 32 moves rearward along the third inclination groove 5*e*. At this time, the first protrusion 42 is positioned in the second inclination groove 5*d*, and the movement speed of the support member 3 in the axial direction D1 is higher than the movement speed of the push-up member 4 in the axial direction D1, so that the support member 3 moves in the axial direction D1 (moves rearward) with respect to the push-up member 4. When the support member 3 moves rearward with respect to the push-up member 4, the cosmetic M moves rearward together with the support member 3 with respect to the push-up member 4.

When the screw tube 5 and the operation portion 21 further relatively rotate with respect to each other in the opposite direction D2*b*, the first protrusion 42 moves from the second inclination groove 5*d* to the first inclination groove 5*c*. The first protrusion 42 moves rearward along the first inclination groove 5*c*, and the second protrusion 32 moves rearward along the third inclination groove 5*e*. At this time, the first protrusion 42 is positioned in the first inclination groove 5*c*, and the movement speed of the push-up member 4 in the axial direction D1 is higher than the movement speed of the support member 3 in the axial direction D1, so that the push-up member 4 moves in the axial direction D1 (moves rearward) with respect to the support member 3. The push-up member 4 starts moving in the axial direction D1 (moving rearward) toward the support member 3 before the support member 3 reaches a bottom dead center which is a lowering limit thereof. In this specification, the "bottom dead center" refers to a position of the support member 3 in a limit in which the support member 3 can move rearward.

When the screw tube 5 and the operation portion 21 further relatively rotate with respect to each other in the opposite direction D2*b*, the cosmetic M is accommodated in the accommodating tube 22, and the lid portion 61 is closed as the push-up member 4 is separated rearward from the lid portion 61. Accordingly, the feeding container 1 is in the accommodating state from the use state. When the lock member 7 is pushed toward the operation portion 21, the feeding container 1 is switched from the unlocked state to the locked state. Since the guide portion 7*f* protrudes radially inward of the lock member 7, when the lock member 7 is pushed toward the operation portion 21, the guide portion 7*f* comes into contact with the lid portion 61 of the inner cap 6. The guide portion 7*f* has a function of gradually closing the lid portion 61 as the lid portion 61 is guided to the lock portion 7*c*. Accordingly, when the guide portion 7*f* comes into contact with the lid portion 61, the first opening 221*a* is gradually closed. In the embodiment, since the guide portion 7*f* has a right triangle shape, the lid portion 61 gradually closes the first opening 221*a* as a front end of the guide portion 7*f* comes into contact with the lid portion 61 from a rear end of the guide portion 7*f*.

Next, operations and effects obtained from the feeding container 1 according to the embodiment will be described. As shown in FIG. 4, FIG. 20A, FIG. 20B, and FIG. 20C, in the feeding container 1, the container 2 includes the accommodating portion 221 for accommodating the cosmetic M and the first opening 221*a* from which the cosmetic M is exposed, and the first opening 221*a* is opened and closed by the lid portion 61. The feeding container 1 includes the lock member 7. The lock member 7 locks the lid portion 61 in a state where the lid portion 61 closes the first opening 221*a*. When the lock member 7 locks the lid portion 61, since the state where the lid portion 61 closes the first opening 221*a* is maintained, it can prevent the first opening 221*a* from being opened unintentionally by the user of the feeding container 1. When the lock member 7 moves in the axial direction D1 with respect to the container 2, the locking of the lid portion 61 is released, and at this time, the cosmetic M can be exposed from the first opening 221*a*. Accordingly, unless the user moves the lock member 7 in the axial direction D1, the locking of the lid portion 61 can be prevented from being released. At this time, the cosmetic M can be restricted from being exposed from the first opening 221*a*. As a result, since the cosmetic M can be prevented from being unintentionally exposed from the first opening 221*a*, it is possible to prevent an object positioned around the feeding container 1 from being contaminated.

The lock member 7 has a tubular shape into which the container 2 is inserted. The container 2 includes the operation portion 21 which is operated to relatively rotate with respect to the lock member 7 in order to feed out the cosmetic M. In a state where the lock member 7 locks the lid portion 61, the operation portion 21 is relatively non-rotatable with respect to the lock member 7. When the locking of the lid portion 61 due to the lock member 7 is released, the operation portion 21 is relatively rotatable with respect to the lock member 7. When the lid portion 61 is locked by the lock member 7, the cosmetic M is less likely to be exposed, and since the operation portion 21 cannot relatively rotate with respect to the lock member 7, it is possible to prevent the cosmetic M from being unintentionally fed out. Accordingly, the cosmetic M can be further prevented from being exposed against the intention of the user.

The lid portion 61 is pivotable via the hinge portion 61*b* provided in the container 2. The lid portion 61 opens and closes the first opening 221*a* by pivoting via the hinge portion 61*b*. The lock member 7 includes the second opening 7*a* in which the cosmetic M fed out from the first opening 221*a* appears, and the lock portion 7*c* that is in contact with the lid portion 61 to lock the lid portion 61. The lid portion 61 is pivotable via the hinge portion 61*b*. The lock member 7 includes the lock portion 7*c* that is in contact with the lid portion 61 to lock the lid portion 61. Accordingly, the lid portion 61 can be more easily locked by the lock portion 7*c* coming into contact with the lid portion 61 along the direction in which the lid portion 61 pivots to close the first opening 221*a*. As a result, it is possible to prevent the cosmetic M from being exposed against the intention of the user. In a state where the lid portion 61 pivots and the first opening 221*a* is opened, the cosmetic M passing through the first opening 221*a* can be exposed through the second opening 7*a*. Accordingly, the cosmetic M can be exposed without removing the lock member 7.

As shown in FIG. 4, FIG. 20A, FIG. 20B, and FIG. 20C, in the feeding container 1, the container 2 includes the accommodating portion 221 for accommodating the cosmetic M and the first opening 221*a* from which the cosmetic M is exposed. The support member 3 which is movable in the axial direction D1 inside the accommodating portion 221 supports the cosmetic M. The feeding container 1 includes the lid portion 61 pivotable via the hinge portion 61*b* and the push-up member 4. The first opening 221*a* is opened and closed by the pivoting of the lid portion 61. The push-up member 4 moves in the axial direction D1 with respect to the support member 3 to push up the lid portion 61 to open the first opening 221*a*. The push-up member 4 moves with respect to the support member 3 supporting the cosmetic M to open the first opening 221*a*, so that the lid portion 61 can be pushed up before the cosmetic M protrudes from the first opening 221*a*. Accordingly, since the cosmetic can be prevented from coming into contact with the lid portion 61, it is possible to prevent the cosmetic M from adhering to the lid portion 61.

As shown in FIGS. 7, 9, and 11, the accommodating portion 221 has the first guide hole 221*b* and the second guide hole 221*c* which extend in the axial direction D1 and penetrate the accommodating portion 221. The push-up member 4 has a tubular shape into which the cosmetic M enters, and is movable in the axial direction D1 inside the accommodating portion 221. The push-up member 4 includes the first protrusion 42 that enters the first guide hole 221*b* in an outer periphery of the push-up member 4. The support member 3 includes the second protrusion 32 that enters the second guide hole 221*c* in an outer periphery of the support member 3. In this case, the first protrusion 42 enters the first guide hole 221*b* of the accommodating portion 221, and the second protrusion 32 enters the second guide hole 221*c* of the accommodating portion 221. The first guide hole 221*b* and the second guide hole 221*c* extend in the axial direction D1. Accordingly, each of the push-up member 4 and the support member 3 is connected to the accommodating portion 221 in a movable state in the axial direction D1. Accordingly, components for connecting each of the push-up member 4 and the support member 3 can be one component (accommodating tube 22). As a result, the size of the feeding container 1 can be reduced.

The feeding container 1 includes the screw tube 5 into which the accommodating portion 221 is inserted and which has a groove in the peripheral wall. The container 2 includes the operation portion 21 which is operated to relatively rotate with respect to the screw tube 5. As shown in FIGS. 9, 11, and 13, the groove of the screw tube 5 includes the first groove 5*a* into which the first protrusion 42 of the push-up member 4 enters, and the second groove 5*b* into which the second protrusion 32 of the support member 3 enters. When the screw tube 5 and the operation portion 21 relatively rotate with respect to each other in the one direction D2*a*, the first protrusion 42 moves along the first groove 5*a*, the push-up member 4 pushes up the lid portion 61 to open the first opening 221*a*, the second protrusion 32 moves along the second groove 5*b*, the support member 3 moves in the axial direction D1, and the cosmetic M is fed out from the first opening 221*a*. In this case, when the operation portion 21 relatively rotates with respect to the screw tube 5 in the one direction D2*a*, the push-up member 4 pushes up the lid portion 61 to open the first opening 221*a*, and the cosmetic M is fed out from the first opening 221*a*. Accordingly, the opening of the first opening 221*a* and the feeding-out of the cosmetic M from the first opening 221*a* can be performed by a single operation.

The first groove 5*a* into which the first protrusion 42 of the push-up member 4 enters includes the first inclination groove 5*c* extending in the first inclination direction D3 which is the direction inclined with respect to the axial direction D1, and the second inclination groove 5*d* extending in the second inclination direction D4 which is the direction inclined with respect to both the axial direction D1 and the first inclination direction D3 from the end portion of the first inclination groove 5*c*. The second groove 5*b* into which the second protrusion 32 of the support member 3 enters includes the third inclination groove 5*e* extending in the third inclination direction D5 which is the direction inclined with respect to the axial direction D1, the first inclination direction D3, and the second inclination direction D4. The angle of the third inclination direction D5 with respect to the axial direction D1 is larger than the angle of the first inclination direction D3 with respect to the axial direction D1 and is smaller than the angle of the second inclination direction D4 with respect to the axial direction D1. The first protrusion 42 moves from the first inclination groove 5*c* toward the second inclination groove 5*d* before or at the same time as the push-up member 4 pushes up the lid portion 61. In this case, before the push-up member 4 pushes up the lid portion 61, the first protrusion 42 moves in the first inclination groove 5*c*, and the second protrusion 32 moves in the third inclination groove 5*e*. The angle of the third inclination direction D5 with respect to the axial direction D1 is larger than the angle of the first inclination direction D3 with respect to the axial direction D1.

Accordingly, the speed at which the push-up member 4 moves in the axial direction D1 to push up the lid portion 61 can be faster than the speed at which the support member 3 moves in the axial direction D1 to feed out the cosmetic M. Accordingly, after the push-up member 4 pushes up the lid portion 61 to open the first opening 221*a*, the support member 3 can feed out the cosmetic M from the first opening 221*a* in this order. The angle of the third inclination direction D5 with respect to the axial direction D1 is smaller than the angle of the second inclination direction D4 with respect to the axial direction D1. Accordingly, after the push-up member 4 pushes up the lid portion 61, the speed at which the support member 3 moves in the axial direction D1 to feed out the cosmetic M can be faster than the speed at which the push-up member 4 moves in the axial direction D1. Accordingly, after the first opening 221*a* is opened, excessive protrusion of the push-up member 4 is prevented, and the cosmetic M can be quickly fed out from the first opening 221*a*.

When the screw tube 5 and the operation portion 21 relatively rotate with respect to each other in the opposite direction D2*b*, the second protrusion 32 moves along the second groove 5*b*, the support member 3 moves in the axial direction D1, and the cosmetic M is returned from the first opening 221*a*. Before the support member 3 reaches the bottom dead center which is the lowering limit thereof, the push-up member 4 starts moving in the axial direction D1 toward the support member 3. In this case, when the operation portion 21 is relatively rotated in the opposite direction D2*b* with respect to the screw tube 5, the push-up member 4 starts moving in the axial direction D1 toward the support member 3 before the support member 3 reaches the bottom dead center. Accordingly, compared to the case where the movement of the push-up member 4 is started after the support member 3 has returned, it is possible to quickly perform the returning operation after the feeding container 1 is used.

As shown in FIGS. 4 and 17, the feeding container 1 includes the lock member 7 having a tubular shape that covers the lid portion 61, accommodates the screw tube 5, and engages with the screw tube 5 in a synchronously rotatable manner. The lock member 7 includes the second opening 7*a* from which the cosmetic M fed out from the first opening 221*a* is exposed, the lock portion 7*c* that locks the lid portion 61 by being in contact with the lid portion 61, and the guide portion 7*f* that protrudes radially inward of the lock member 7 from the peripheral wall and guides the lid portion 61. In this case, since the lock member 7 covers the lid portion 61, the lid portion 61 is protected by the lock member 7 and is less likely to be damaged. Since the lock member 7 has the second opening 7*a* from which the cosmetic M fed out from the first opening 221*a* is exposed, the cosmetic M can be exposed without removing the lock member 7. Accordingly, the lid portion 61 is further less likely to be damaged. Since the lid portion 61 is guided by the guide portion 7*f* protruding radially inward of the lock member 7 from the peripheral wall and is locked by the lock portion 7*c*, the lid portion 61 is likely to be closed before the lock portion 7*c* comes into contact with the lid portion 61. Since the lock member 7 accommodates the screw tube 5 and engages with the screw tube 5 in a synchronously rotatable manner, the lock member 7 can relatively rotate with respect to the operation portion 21. Accordingly, the user can easily relatively rotate the operation portion 21 by holding the lock member 7.

The feeding container according to the present disclosure in the embodiment has been described above. However, the feeding container according to the present disclosure is not limited to the above-described embodiment, and may be further modified within the scope of the gist described in the claims. That is, the shape, size, material, number, and arrangement form of each component of the feeding container according to the present disclosure can be appropriately changed within the scope of the gist described above.

The lid portion may open and close the first opening 221*a* in a state where the lid portion is connected to any one of the lock member 7, the container 2, and the screw tube 5. For example, the lid portion may open and close the first opening 221*a* in a state where the lid portion is connected to the lock member 7. In a feeding container according to a modification, instead of the inner cap 6 including the lid portion 61 and the lock member 7 including the guide portion 7*f*, a lid portion connected to the lock member 7 may be provided. The lid portion may be pivotable via a hinge portion provided on the inner peripheral surface of the lock member 7. The lid portion may be closed when any one of the front end of the inner cap 6, the front end of the screw tube 5, and the front end of the container 2 comes into contact with the lid portion toward the front end of the lock member 7. On the other hand, the lid portion may be opened when the front end of the inner cap 6, the front end of the screw tube 5, and the front end of the container 2 are separated from the front end of the lock member 7.

A timing at which the first protrusion 42 moves can be appropriately changed. The same applies to the second protrusion 32 of the support member 3.

In the above-described embodiment, an example has been described in which the accommodating portion 221 of the container 2 has the first guide hole 221*b* and the second guide hole 221*c*, the push-up member 4 includes the first protrusion 42 to be inserted into the first guide hole 221*b*, and the support member 3 includes the second protrusion 32 to be inserted into the second guide hole 221*c*. However, the accommodating portion may not have the guide hole, and the push-up member and the support member may not have the protrusion. Accordingly, the configurations of the container, the push-up member, and the support member can be appropriately changed. The configuration of the screw tube is not limited to the above-described screw tube 5, and may be appropriately changed.

In the above-described embodiment, the inner cap 6 including the hinge type lid portion 61 that is pivotable via the hinge portion 61*b* has been described. However, the lid portion is not limited to the hinge type lid portion, and the type of the lid portion is not particularly limited as long as the lid portion has a structure capable of opening and closing the first opening of the container. Further, the lid portion may not be provided on the inner cap 6. For example, the lock member 7 may include a lid portion instead of the inner cap 6. In this case, the locking of the lid portion may be released when the lock member 7 is moved in the axial direction D1 with respect to the container 2 (the operation portion 21), and the lid portion may be opened by the own weight of the lid portion. Accordingly, the type of the component including the lid portion and the opening and closing means of the lid portion can be appropriately changed.

In the above-described embodiment, the feeding container 1 includes the container 2 including the operation portion 21 which is relatively rotatable with respect to the lock member 7. In the locked state, the operation portion 21 is relatively non-rotatable with respect to the lock member 7. In the unlocked state, the cosmetic M is fed out and returned by the relative rotation of the operation portion 21 with respect to the lock member 7. However, the lock member 7 may be moved in the axial direction D1 with respect to the container 2 and the locking of the lid portion 61 may be released due to a screwing action being applied to the relative rotation between the lock member 7 and the operation portion 21. Further, the feeding container may not feed the cosmetic by relative rotation. The feeding container may include a feeding mechanism which is a mechanical pushing mechanism such as a knocking type instead of relative rotation, and may push the cosmetic by the feeding mechanism or may include a squeeze type feeding mechanism. Accordingly, the type of the feeding mechanism can be appropriately changed.

As described above, according to one advantageous aspect of the present disclosure, there is provided a feeding container including:

a container that includes a tubular accommodating portion configured to accommodate a cosmetic and has a first opening from which the cosmetic is exposed;

a lid portion configured to open and close the first opening; and a lock member configured to lock the lid portion in a state where the lid portion closes the first opening, wherein the lid portion opens and closes the first opening in a state where the lid portion is connected to at least one of the lock member and the container, and when the lock member moves in an axial direction, which is a direction in which an axis of the accommodating portion extends, with respect to the container, locking of the lid portion due to the lock member is released, and the cosmetic is allowed to be exposed from the first opening.

In the feeding container, the container includes the accommodating portion for accommodating the cosmetic and the first opening from which the cosmetic is exposed, and the first opening is opened and closed by the lid portion. The feeding container includes the lock member. The lock member locks the lid portion in a state where the lid portion closes the first opening. When the lock member locks the lid portion, since the state where the lid portion closes the first opening is maintained, it can prevent the first opening from being opened unintentionally by the user of the feeding container. When the lock member moves in the axial direction with respect to the container, the locking of the lid portion is released, and at this time, the cosmetic can be exposed from the first opening. Accordingly, unless the user moves the lock member in the axial direction, the locking of the lid portion can be prevented from being released. At this time, the cosmetic can be restricted from being exposed from the first opening. As a result, since the cosmetic can be prevented from being unintentionally exposed from the first opening, it is possible to prevent an object positioned around the feeding container from being contaminated.

The feeding container may be configured such that the lock member has a tubular shape into which the container is inserted, the container includes an operation portion that is operated to relatively rotate with respect to the lock member in order to feed out the cosmetic, the operation portion is relatively non-rotatable with respect to the lock member in a state where the lock member locks the lid portion, and the operation portion is relatively rotatable with respect to the lock member when the locking of the lid portion due to the lock member is released. In this case, when the lid portion is locked to the lock member, the cosmetic is less likely to be exposed, and since the operation portion cannot relatively rotate with respect to the lock member, it is possible to prevent the cosmetic from being unintentionally fed out. Accordingly, the cosmetic can be further prevented from being exposed against the intention of the user.

The feeding container may be configured such that the lid portion is pivotable via a hinge portion of the container, and opens and closes the first opening by pivoting via the hinge portion, and the lock member includes a second opening in which the cosmetic fed out from the first opening appears and a lock portion that is in contact with the lid portion to lock the lid portion. In this case, the lid portion is pivotable via a hinge portion. The lock member includes a lock portion that is in contact with the lid portion to lock the lid portion. Accordingly, the lid portion can be more easily locked by the lock portion coming into contact with the lid portion along a direction in which the lid portion pivots to close the first opening. As a result, it is possible to prevent the cosmetic from being exposed against the intention of the user. In a state where the lid portion pivots and the first opening is opened, the cosmetic passing through the first opening can be exposed through the second opening. Accordingly, the cosmetic can be exposed without removing the lock member.

According to another advantageous aspect of the present disclosure, there is provided a feeding container including:

- a container that includes a tubular accommodating portion configured to accommodate a cosmetic and has a first opening from which the cosmetic is exposed;
- a support member configured to support the cosmetic inside the accommodating portion and to be movable in an axial direction which is a direction in which an axis of the accommodating portion extends;
- a lid portion being pivotable via a hinge portion and to open and close the first opening by pivoting via the hinge portion; and
- a push-up member configured to move in the axial direction with respect to the support member, and push up the lid portion to open the first opening.

In the feeding container, the container includes the accommodating portion for accommodating the cosmetic and the first opening from which the cosmetic is exposed. The support member which is movable in the axial direction inside the accommodating portion supports the cosmetic. The feeding container includes the lid portion pivotable via the hinge portion and a push-up member. The first opening is opened and closed by the pivoting of the lid portion. The push-up member moves in the axial direction with respect to the support member to push up the lid portion to open the first opening. The push-up member moves with respect to the support member supporting the cosmetic to open the first opening, so that the lid portion can be pushed up before the cosmetic protrudes from the first opening. Accordingly, since the cosmetic can be prevented from coming into contact with the lid portion, it is possible to prevent the cosmetic from adhering to the lid portion.

The feeding container may be configured such that the accommodating portion has one or more guide holes penetrating the accommodating portion and extending in the axial direction, and the push-up member has a tubular shape into which the cosmetic is inserted and is movable in the axial direction inside the accommodating portion, and the push-up member includes a first protrusion that enters the guide hole on an outer periphery of the push-up member, and the support member has a second protrusion that enters the guide hole on an outer periphery of the support member. In this case, each of the first protrusion and the second protrusion enters the guide hole of the accommodating portion. The guide hole extends in the axial direction. Accordingly, each of the push-up member and the support member is connected to the accommodating portion in a movable state in the axial direction. Accordingly, components for connecting each of the push-up member and the support member can be one component. As a result, the size of the feeding container can be reduced.

The feeding container may further include a screw tube into which the accommodating portion is inserted, and having a groove in a peripheral wall, and be configured such that the container includes an operation portion that is operated to relatively rotate with respect to the screw tube, the groove includes a first groove into which the first protrusion of the push-up member is inserted and a second groove into which the second protrusion of the support member is inserted, and when the operation portion relatively rotate with respect to the screw tube in one direction, the first protrusion moves along the first groove, the push-up member pushes up the lid portion to open the first opening, the second protrusion moves along the second groove, and the support member moves in the axial direction to feed out the cosmetic from the first opening. In this case, when the operation portion relatively rotates with respect to the screw tube in the one direction, the push-up member pushes up the lid portion to open the first opening, and the cosmetic is fed out from the first opening. Accordingly, the opening of the first opening and the feeding-out of the cosmetic from the first opening can be performed by a single operation.

The feeding container may be configured such that the first groove includes a first inclination groove that extends in a first inclination direction, which is a direction inclined with respect to the axial direction, and a second inclination groove that extends in a second inclination direction which is a direction inclined with respect to both the axial direction and the first inclination direction from an end portion of the first inclination groove, the second groove includes a third inclination groove that extends in a third inclination direction which is a direction inclined with respect to the axial direction, the first inclination direction, and the second inclination direction, and an angle of the third inclination direction with respect to the axial direction is larger than an angle of the first inclination direction with respect to the axial direction and is smaller than an angle of the second inclination direction with respect to the axial direction, and the first protrusion moves from the first inclination groove toward the second inclination groove before or at the same time as the push-up member pushes up the lid portion. In this case, before or at the same time as the push-up member pushes up the lid portion, the first protrusion moves in the first inclination groove, and the second protrusion moves in the third inclination groove. The angle of the third inclination direction with respect to the axial direction is larger than the angle of the first inclination direction with respect to the axial direction. Accordingly, the speed at which the push-up member moves in the axial direction to push up the lid portion can be faster than the speed at which the support member moves in the axial direction to feed out the cosmetic. Accordingly, after the push-up member pushes up the lid portion to open the first opening, the support member can feed out the cosmetic from the first opening in this order. The angle of the third inclination direction with respect to the axial direction is smaller than the angle of the second inclination direction with respect to the axial direction. Accordingly, after the push-up member pushes up the lid portion, the speed at which the support member moves in the axial direction to feed out the cosmetic can be faster than the speed at which the push-up member moves in the axial direction. Accordingly, after the first opening is opened, excessive protrusion of the push-up member is prevented, and the cosmetic can be quickly fed out from the first opening.

The feeding container may be configured such that when the operation portion relatively rotate with respect to the screw tube in a direction opposite to the one direction, the second protrusion moves along the second groove, the support member moves in the axial direction, and the cosmetic is returned from the first opening, and before the support member reaches a bottom dead center which is a lowering limit of the support member, the push-up member starts moving in the axial direction toward the support member. In this case, when the operation portion is relatively rotated in the opposite direction with respect to the screw tube, the push-up member starts moving in the axial direction toward the support member before the support member reaches the bottom dead center. Accordingly, compared to the case where the movement of the push-up member is started after the support member has returned, it is possible to quickly perform the returning operation after the feeding container is used.

The feeding container may further include a tubular lock member configured to cover the lid portion, accommodate the screw tube, and engage with the screw tube in a synchronously rotatable manner, and be configured such that the lock member includes a second opening from which the cosmetic fed out from the first opening is exposed, a lock portion that locks the lid portion by being in contact with the lid portion, and a guide portion that protrudes inward in a radial direction of the lock member from the peripheral wall and guides the lid portion. In this case, since the lock member covers the lid portion, the lid portion is protected by the lock member and is less likely to be damaged. Since the lock member has the second opening from which the cosmetic fed out from the first opening is exposed, the cosmetic can be exposed without removing the lock member. Accordingly, the lid portion is further less likely to be damaged. Since the lid portion is guided by the guide portion protruding radially inward of the lock member from the peripheral wall, the lid portion is likely to be closed before the lock portion comes into contact with the lid portion. Since the lock member accommodates the screw tube and engages with the screw tube in a synchronously rotatable manner, the lock member can relatively rotate with respect to the operation portion. Accordingly, the user can easily relatively rotate the operation portion by holding the lock member.

According to the present disclosure, it is possible to prevent the cosmetic from being exposed against the intention of the user.

According to the present disclosure, it is possible to prevent the cosmetic from adhering to the lid portion.

What is claimed is:

1. A feeding container comprising:

a container that includes a tubular accommodating portion configured to accommodate a cosmetic and has a first opening from which the cosmetic is exposed;

a lid portion configured to open and close the first opening; and a lock member configured to lock the lid portion in a state where the lid portion closes the first opening, wherein the lid portion opens and closes the first opening in a state where the lid portion is connected to at least one of the lock member and the container, when the lock member moves in an axial direction, which is a direction in which an axis of the accommodating portion extends, with respect to the container, locking of the lid portion due to the lock member is released, and the cosmetic is allowed to be exposed from the first opening, the lock member has a tubular shape into which the container is inserted, the container includes an operation portion that is operated to relatively rotate with respect to the lock member in order to feed out the cosmetic, the operation portion is relatively non-rotatable with respect to the lock member in a state where the lock member locks the lid portion, and the operation portion is relatively rotatable with respect to the lock member when the locking of the lid portion due to the lock member is released.

2. The feeding container according to claim 1, wherein the lid portion is pivotable via a hinge portion of the container, and opens and closes the first opening by pivoting via the hinge portion, and the lock member includes a second opening in which the cosmetic fed out from the first opening appears and a lock portion that is in contact with the lid portion to lock the lid portion.

3. A feeding container comprising:

a container that includes a tubular accommodating portion configured to accommodate a cosmetic and has a first opening from which the cosmetic is exposed;

a support member configured to support the cosmetic inside the accommodating portion and to be movable in an axial direction which is a direction in which an axis of the accommodating portion extends;

a lid portion being pivotable via a hinge portion and to open and close the first opening by pivoting via the hinge portion;

a push-up member configured to move in the axial direction with respect to the support member, and push up the lid portion to open the first opening; and a screw tube into which the accommodating portion is inserted, and having grooves in a peripheral wall, wherein the accommodating portion has one or more guide holes penetrating the accommodating portion and extending in the axial direction, and the push-up member has a tubular shape into which the cosmetic is inserted and is movable in the axial direction inside the accommodating portion, the push-up member includes a first protrusion that enters the guide hole on an outer periphery of the push-up member, and the support member has a second protrusion that enters the guide hole on an outer periphery of the support member, the container includes an operation portion that is operated to relatively rotate with respect to the screw tube, the grooves include a first groove into which the first protrusion of the push-up member is inserted and a second groove into which the second protrusion of the support member is inserted, when the operation portion relatively rotates with respect to the screw tube in one direction, the first protrusion moves along the first groove, the push-up member pushes up the lid portion to open the first opening, the second protrusion moves along the second groove, and the support member moves in the axial direction to feed out the cosmetic from the first opening, the first groove includes a first inclination groove that extends in a first inclination direction, which is a direction inclined with respect to the axial direction, the second groove includes a third inclination groove that extends in a third inclination direction which is a direction inclined with respect to the axial direction and the first inclination direction, and an angle of the third inclination direction with respect to the axial direction is larger than an angle of the first inclination direction with respect to the axial direction.

4. The feeding container according to claim 3, wherein the first groove includes a second inclination groove that extends in a second inclination direction which is a direction inclined with respect to both the axial direction and the first inclination direction from an end portion of the first inclination groove, and an angle of the third inclination direction with respect to the axial direction is smaller than an angle of the second inclination direction with respect to the axial direction, and the first protrusion moves from the first inclination groove toward the second inclination groove before or at the same time as the push-up member pushes up the lid portion.

5. The feeding container according to claim 3, wherein when the operation portion relatively rotate with respect to the screw tube in a direction opposite to the one direction, the second protrusion moves along the second groove, the support member moves in the axial direction, and the cosmetic is returned from the first opening, and before the support member reaches a bottom dead center which is a lowering limit of the support member, the push-up member starts moving in the axial direction toward the support member.

6. A feeding container comprising:

a container that includes a tubular accommodating portion configured to accommodate a cosmetic and has a first opening from which the cosmetic is exposed;

a support member configured to support the cosmetic inside the accommodating portion and to be movable in an axial direction which is a direction in which an axis of the accommodating portion extends;

a lid portion being pivotable via a hinge portion and to open and close the first opening by pivoting via the hinge portion;

a push-up member configured to move in the axial direction with respect to the support member, and push up the lid portion to open the first opening;

a screw tube into which the accommodating portion is inserted, and having grooves in a peripheral wall; and a tubular lock member configured to cover the lid portion, accommodate the screw tube, and engage with the screw tube in a synchronously rotatable manner, wherein the accommodating portion has one or more guide holes penetrating the accommodating portion and extending in the axial direction, and the push-up member has a tubular shape into which the cosmetic is inserted and is movable in the axial direction inside the accommodating portion, the push-up member includes a first protrusion that enters the guide hole on an outer periphery of the push-up member, and the support member has a second protrusion that enters the guide hole on an outer periphery of the support member, the container includes an operation portion that is operated to relatively rotate with respect to the screw tube, the grooves include a first groove into which the first protrusion of the push-up member is inserted and a second groove into which the second protrusion of the support member is inserted, when the operation portion relatively rotates with respect to the screw tube in one direction, the first protrusion moves along the first groove, the push-up member pushes up the lid portion to open the first opening, the second protrusion moves along the second groove, and the support member moves in the axial direction to feed out the cosmetic from the first opening, and the lock member includes a second opening from which the cosmetic fed out from the first opening is exposed, a lock portion that locks the lid portion by being in contact with the lid portion, and a guide portion that protrudes inward in a radial direction of the lock member from the peripheral wall and guides the lid portion.

* * * * *